US009930980B2

(12) United States Patent
Pau

(10) Patent No.: US 9,930,980 B2
(45) Date of Patent: Apr. 3, 2018

(54) BEVERAGE CONTAINER

(71) Applicant: Groking Lab Limited, Kowloon (HK)

(72) Inventor: Sze Ring Pau, Kowloon (HK)

(73) Assignee: GROKING LAB LIMITED, Kowloon (HK)

( * ) Notice: Subject to any disclaimer, the term of this patent is extended or adjusted under 35 U.S.C. 154(b) by 104 days.

(21) Appl. No.: 15/079,122

(22) Filed: Mar. 24, 2016

(65) Prior Publication Data

US 2016/0286993 A1 Oct. 6, 2016

Related U.S. Application Data

(60) Provisional application No. 62/199,359, filed on Jul. 31, 2015.

(30) Foreign Application Priority Data

Apr. 2, 2015 (HK) ..... 15103376

(51) Int. Cl.
*G08B 21/00* (2006.01)
*A47G 19/22* (2006.01)
*A47G 23/16* (2006.01)

(52) U.S. Cl.
CPC ..... *A47G 19/2227* (2013.01); *A47G 19/2288* (2013.01); *A47G 23/16* (2013.01); *A47G 2019/225* (2013.01); *A47G 2019/2238* (2013.01); *A47G 2019/2244* (2013.01)

(58) Field of Classification Search
None
See application file for complete search history.

(56) References Cited

U.S. PATENT DOCUMENTS 4,406,382 A * 9/1983 Roth ..... B67D 1/1247 137/551
5,482,373 A * 1/1996 Hutchinson ..... G01K 11/12 374/141
5,532,673 A * 7/1996 Olson ..... B60R 16/0232 340/450.2
5,689,265 A * 11/1997 Otto ..... G01F 23/284 340/612
5,755,136 A * 5/1998 Getman ..... G01F 23/2961 340/618
6,028,521 A * 2/2000 Issachar ..... G01F 23/62 340/618
6,057,773 A * 5/2000 Shukla ..... B01F 13/0818 200/61.45 R
6,591,201 B1 * 7/2003 Hyde ..... G01F 25/0007 700/281
7,068,175 B1 * 6/2006 Pennington ..... G01F 23/66 340/450
7,298,281 B2 * 11/2007 Cupples ..... G01F 25/0061 340/514
7,798,373 B1 * 9/2010 Wroblewski ..... A47J 41/0033 222/1

(Continued)

*Primary Examiner* — Curtis King
(74) *Attorney, Agent, or Firm* — Renner Kenner Greive Bobak Taylor & Weber

(57) ABSTRACT

A beverage container includes a container body, a plurality of sensors arranged to determine information associated with liquid contained in the container body, and a processor operably coupled with the plurality of sensors for determining a beverage consumption routine of a user based on the information determined by the plurality of sensors.

22 Claims, 13 Drawing Sheets

(56) References Cited

U.S. PATENT DOCUMENTS 7,840,360 B1 * 11/2010 Micheels ..... G01J 3/42 250/223 B
D724,894 S * 3/2015 Brosius ..... D7/510
9,647,777 B2 * 5/2017 Wang ..... H04H 20/63
2002/0100317 A1 * 8/2002 Deserno ..... G01F 23/284 73/290 V
2002/0161652 A1 * 10/2002 Paullin ..... G06Q 20/202 705/22
2005/0126126 A1 * 6/2005 Ours ..... B65B 1/06 53/442
2006/0033631 A1 * 2/2006 Cupples ..... G01F 23/18 340/612
2006/0119484 A1 * 6/2006 Chishima ..... G01G 17/04 340/612
2007/0103324 A1 * 5/2007 Kosuge ..... E03F 7/00 340/618
2008/0060962 A1 * 3/2008 Gibson ..... A47G 23/16 206/459.5
2008/0296181 A1 * 12/2008 Stephens ..... A47G 23/16 206/217
2009/0143899 A1 * 6/2009 Hyde ..... G07F 13/025 700/231
2009/0143900 A1 * 6/2009 Hyde ..... G06F 19/3462 700/231
2009/0144184 A1 * 6/2009 Hyde ..... G06F 19/3406 705/35
2009/0144190 A1 * 6/2009 Hyde ..... G06Q 10/10 705/38
2009/0149988 A1 * 6/2009 Hyde ..... A61J 7/0481 700/231
2009/0169419 A1 * 7/2009 Hyde ..... A61L 2/04 422/1
2009/0254215 A1 * 10/2009 Hyde ..... G06F 19/3406 700/236
2010/0193462 A1 * 8/2010 Roth ..... A47G 19/2288 215/229
2010/0286820 A1 * 11/2010 Hyde ..... G06Q 10/10 700/244
2010/0300913 A1 * 12/2010 Goldburt ..... B65D 23/12 206/459.1
2010/0312384 A1 * 12/2010 Hyde ..... G06F 19/3462 700/244
2010/0312570 A1 * 12/2010 Shimo ..... G06Q 30/02 705/1.1
2011/0149693 A1 * 6/2011 Liao ..... G04C 23/48 368/10
2011/0186738 A1 * 8/2011 Itozaki ..... G01N 21/359 250/340
2012/0097567 A1 * 4/2012 Zhao ..... A47G 23/16 206/459.1
2013/0060224 A1 * 3/2013 Young Jones ..... A61J 11/002 604/500
2014/0041955 A1 * 2/2014 Lopez ..... G01N 33/4972 180/272
2014/0046596 A1 * 2/2014 Chang ..... G06F 19/3475 702/3
2014/0053944 A1 * 2/2014 Wang ..... B67C 3/007 141/1
2014/0236351 A1 * 8/2014 Hyde ..... G06Q 50/22 700/244
2014/0303790 A1 * 10/2014 Huang ..... G06F 19/3475 700/281
2014/0340229 A1 * 11/2014 Wu ..... G08B 21/24 340/603
2014/0354438 A1 * 12/2014 Hazen ..... G08B 21/182 340/618
2014/0372045 A1 * 12/2014 Keski-Pukkila ..... A61B 5/6887 702/19
2015/0108026 A1 * 4/2015 Azimi ..... G01F 23/2962 206/459.1
2015/0122688 A1 * 5/2015 Dias ..... A47G 19/025 206/459.1
2015/0182797 A1 * 7/2015 Wernow ..... G06F 19/3418 434/247
2015/0334079 A1 * 11/2015 Laidlaw ..... H04L 51/38 340/539.11
2015/0339914 A1 * 11/2015 Kekalainen ..... G01D 4/002 340/506
2015/0366383 A1 * 12/2015 Raunio ..... G09G 5/006 345/156
2016/0220180 A1 * 8/2016 Fateh ..... A61J 7/0427
2016/0220184 A1 * 8/2016 Manion ..... A61B 5/4875
2016/0348842 A1 * 12/2016 Crouse ..... G01F 23/284
2017/0067770 A1 * 3/2017 Sun ..... G01F 15/063
2017/0156540 A1 * 6/2017 Wheatley ..... A47J 31/005
2017/0176238 A1 * 6/2017 Dubey ..... G01G 17/04

* cited by examiner

BEVERAGE CONTAINER

TECHNICAL FIELD

The present invention relates to a beverage container and particularly, although not exclusively, to a smart beverage container operable to determine information related to the liquid contained in the container so as to determine a beverage consumption routine of a user.

BACKGROUND

Water plays an important physiological role in the survival of human beings as a large portion of the human body, in terms of weight or volume, is made up of water. In order for the body to properly grow, develop and operate, fluid balance in the body is essential. Depending on the age, gender, weight, height, and other body conditions, the body water requirement for different people may be different.

The human body has the intrinsic ability to regulate water content in different tissues and organs of different body parts, and it can produce a thirst sensation to remind the body the need to consume fluid to stay properly hydrated when the water content of the body falls below a threshold as detected by the brain.

Although the human body has self-regulatory functions, in this rapidly paced society, people are busy with a lot of different tasks and work and they often neglect the signals generated by their body as well as the importance of a healthy diet. For example, people may consume an excessive amount of caffeine (e.g., coffee or tea) as an attempt to reduce physical fatigue or drowsiness. In another example, people may consume insufficient amount of water by being sedentary, and by heavily focusing on the work they have without attending to their body needs. The fact that a lot of people are unconcerned with the signals generated by their body or are unaware of these unhealthy habits is problematic and alarming.

There is a need for the dietary habits (e.g., eating or drinking habits) of an individual to be monitored, recorded and/or analysed so as to help the individual to improve their dietary habits, or at least reminding them of the unhealthy habits that they have.

SUMMARY OF THE INVENTION

In accordance with a first aspect of the present invention, there is provided a beverage container comprising a container body, wherein the beverage container includes: a plurality of sensors arranged to determine information associated with liquid contained in the container body; and a processor operably coupled with the plurality of sensors for determining a beverage consumption routine of a user based on the information determined by the plurality of sensors.

In one embodiment of the first aspect, the plurality of sensors are further arranged to determine one or more beverage consumption events or beverage filling events; and the processor is further arranged to determine the beverage consumption routine of a user of the beverage container based on the one or more beverage consumption events or beverage filling events.

In one embodiment of the first aspect, the beverage consumption routine includes one or more of: type of the liquid consumed by the user, volume of the liquid consumed by the user, and time at which the liquid is consumed by the user.

In one embodiment of the first aspect, the processor is arranged to determine a beverage consumption alarm to be provided to the user based on the beverage consumption routine of the user; wherein the beverage consumption alarm is arranged to remind the user of consumption of liquid from the beverage container.

In one embodiment of the first aspect, the beverage container further comprises an alarm module operably coupled with the processor for providing the beverage consumption alarm to the user.

In one embodiment of the first aspect, the plurality of sensors includes a linear array of level sensors arranged at least partly lengthwise along the container body for detecting a level of the liquid in the container body so as to determine a volume of liquid in the container body.

In one embodiment of the first aspect, the plurality of sensors further includes a temperature sensor arranged to detect a temperature of the liquid in the container body.

In one embodiment of the first aspect, the plurality of sensors further includes a liquid detector arranged to detect the type of the liquid contained in the container body.

In one embodiment of the first aspect, the plurality of sensors further includes a motion sensor arranged to detect a motion of the beverage container being picked up.

In one embodiment of the first aspect, the beverage container further comprises a lid removably coupled with the container body.

In one embodiment of the first aspect, the plurality of sensors further includes a lid state sensor arranged to detect if the lid is opened or closed, or connected with or disconnected from the container body.

In one embodiment of the first aspect, the beverage container further comprises a clock or timing module operably coupled with the processor for recording time of events occurred.

In one embodiment of the first aspect, the beverage container further comprises an indicator module operably coupled with the processor for indicating one or more of the temperature, the volume, and the type of liquid contained in the container body.

In one embodiment of the first aspect, the beverage container further comprises a communication module operably coupled with the processor arranged to communicate data with an external electronic device.

In one embodiment of the first aspect, the beverage container further comprises a power module operably coupled with the processor and the plurality of sensors for selectively powering the processor and one or more of the plurality of sensors.

In one embodiment of the first aspect, the beverage container further comprises a memory module operably coupled with the processor for storing one or more beverage consumption events or beverage filling events, the information determined by the plurality of sensors, the beverage consumption routine of the user and/or a beverage consumption alarm schedule.

In one embodiment of the first aspect, the container body comprises an inner container body and an outer container body; a space defined between the inner and outer container bodies are arranged for housing the processor and one or more of the plurality of sensors.

In one embodiment of the first aspect, the inner and outer container bodies are made of heat insulating materials.

In one embodiment of the first aspect, the alarm module includes one or more light emitting devices for providing visible alarm, a vibration motor for providing tactile alarm, a sound emitting device for providing an audible alarm, or any combinations thereof.

In one embodiment of the first aspect, the container body includes a beverage chamber with a cross section defined by a continuous slot portion and major segment portion, the slot portion defining a channel extending at least partly lengthwise along the beverage chamber; wherein the linear array of level sensors are arranged along the channel defined by the slot portion.

In one embodiment of the first aspect, each level sensor includes an infrared transmitter and an infrared emitter.

In one embodiment of the first aspect, the infrared transmitter and the infrared emitter of each level sensor are arranged proximal each other in a non-diametrically opposed manner.

In one embodiment of the first aspect, the temperature sensor is a thermistor.

In one embodiment of the first aspect, the liquid detector is an infrared transmitter and an infrared emitter.

In one embodiment of the first aspect, the liquid detector is operable to determine if the liquid contained in the container body is water or coffee.

In one embodiment of the first aspect, the motion sensor comprises one or more of an accelerometer, a gyroscope, and a magnetometer.

In one embodiment of the first aspect, the lid state sensor is a magnetic switch.

In one embodiment of the first aspect, the processor is operable to determine a beverage consumption event or a beverage filling event based on the motion of the beverage container detected by the motion sensor and a lid state detected by the lid state sensor.

In one embodiment of the first aspect, the events occurred and recorded by the clock and timing module include one or more of: a beverage consumption event, a beverage filling event, a liquid level detected, a liquid temperature detected, and a type of liquid detected.

In one embodiment of the first aspect, the indicator module includes one or more light emitting indicators.

In one embodiment of the first aspect, the communication module is arranged to communicate the beverage consumption routine of the user to the external electronic device.

In one embodiment of the first aspect, the communication module is a wireless communication module arranged to communicate with the external electronic device using wireless communication signals.

In one embodiment of the first aspect, the communication module is a Bluetooth module that communicates with the external electronic device using Bluetooth signals.

In one embodiment of the first aspect, the power module comprises a rechargeable battery.

In one embodiment of the first aspect, the beverage container is operable in an idle mode when the beverage container is not being used by the user; and in an active mode when the beverage container is being used by the user; wherein in the idle mode, only the motion sensor and the lid state sensor are in an operation state and the other of the plurality of sensors are in a reduced power state; and in the active mode, the motion sensor, the lid state sensor and one or more of the other plurality of sensors are in an operation state.

In accordance with a second aspect of the present invention, there is provided a beverage consumption routine determination system, comprising: a beverage container operable to determine a beverage consumption routine of a user; and an external electronic device arranged to communicate with the beverage container; wherein the beverage consumption routine of the user is arranged to be transmitted from the beverage container to the external electronic device for storage in the external electronic device or in a server using the external electronic device.

In one embodiment of the second aspect, the server is distributed in a cloud computing network.

In one embodiment of the second aspect, the external electronic device is arranged to communicate with the beverage container using wireless communication signals.

In one embodiment of the second aspect, the user can manipulate records of the beverage consumption routine using the external electronic device.

In one embodiment of the second aspect, the user can set a predetermined beverage consumption alarm and transmit the predetermined beverage consumption alarm to the beverage container using the external electronic device.

In one embodiment of the second aspect, the beverage container is the beverage container in accordance with the first aspect of the present invention.

In accordance with a third aspect of the present invention, there is provided a method for determining a beverage consumption routine of a user of a beverage container, comprising the steps of: determining one or more beverage consumption event or beverage filling event of the beverage container; determining information related to liquid contained in the beverage container; and determining the beverage consumption routine of the user of the beverage container based on the one or more events and the information determined.

In one embodiment of the third aspect, the information related to liquid contained in the beverage container includes one or more of: type, temperature, and volume of the liquid, and a time at which the information is determined.

In one embodiment of the third aspect, the step of determining one or more beverage consumption event or beverage filling event of the beverage container includes determining a time at which the beverage consumption event or beverage filling event occurs.

In one embodiment of the third aspect, the beverage consumption routine includes one or more of: type of the liquid consumed by the user, volume of the liquid consumed by the user, and time at which the liquid is consumed by the user.

In one embodiment of the third aspect, the method further comprises the step of determining a beverage consumption alarm to be provided to the user based on the beverage consumption routine of the user, wherein the beverage consumption alarm is arranged to remind the user of consumption of liquid from the beverage container.

In one embodiment of the third aspect, the method further comprises the step of storing the beverage consumption routine of the user in a server.

In one embodiment of the third aspect, the server is distributed in a cloud computing network.

In one embodiment of the third aspect, the beverage container is the beverage container in accordance with the first aspect or the beverage container in the beverage consumption routine determination system in accordance with the second aspect.

In accordance with a fourth aspect of the present invention, there is provided a beverage container comprising a container body and a lid removably coupled with the container body, wherein the beverage container includes a plurality of sensors arranged to determine information associated with liquid contained in the container body and one or more beverage consumption events or beverage filling events; and a processor operably coupled with the plurality of sensors for determining a beverage consumption routine of a user based on the information determined by the plurality of sensors and the one or more beverage consumption events or beverage filling events, and for determining a beverage consumption alarm to be provided to the user based on the beverage consumption routine of the user; wherein the beverage consumption alarm is arranged to remind the user of consumption of liquid from the beverage container; an alarm module operably coupled with the processor for providing the beverage consumption alarm to the user; and a communication module operably coupled with the processor arranged to communicate data with an external electronic device; and wherein the plurality of sensors include a linear array of level sensors arranged at least partly lengthwise along the container body for detecting a level of the liquid in the container body so as to determine a volume of liquid in the container body; a temperature sensor arranged to detect a temperature of the liquid in the container body; a liquid detector arranged to detect the type of the liquid contained in the container body; a motion sensor arranged to detect a motion of the beverage container being picked up; and a lid state sensor arranged to detect if the lid is opened or closed, or connected with or disconnected from the container body.

In accordance with a fifth aspect of the present invention, there is provided a liquid container comprising: a container body with a first portion and a second portion continuous with the first portion, the first and second portions together define a volume for receiving liquid; a plurality of emitters and receivers forming emitter-receiver pairs arranged external to the second portion of the container body and spaced apart along a lengthwise direction of the second portion of the container body; the emitter of each of the plurality of emitter-receiver pairs is arranged to transmit a signal towards the corresponding receiver of the plurality of emitter-receiver pairs through the second portion of the container body; wherein the plurality of emitter-receiver pairs include: one or more first emitter-receiver pairs forming level sensors for detecting an amount of liquid in the container body; and a second emitter-receiver pair forming a liquid detector for detecting a type of liquid contained in the container body.

In one embodiment of the fifth aspect, the second portion comprises a first wall, a second wall, and a third wall arranged between the first and second walls; the first, second and third walls being formed continuously; and the first and second walls being arranged adjacent the plurality of emitter-receiver pairs and between the emitter and the receiver of each of the plurality of emitter-receiver pairs. Preferably, the first, second and third walls are formed integrally.

In one embodiment of the fifth aspect, portions of the first and second walls arranged between each of the one or more first emitter-receiver pairs are substantially planar and are arranged at an angle of less than 90 degrees with each other, and portions of the first and second walls arranged between the second emitter-receiver pair are substantially planar and are arranged parallel with each other. Preferably, portions of the first and second walls arranged between each of the one or more first emitter-receiver pairs are arranged at an angle between 45-75 degrees. More preferably, portions of the first and second walls arranged between each of the one or more first emitter-receiver pairs are arranged at an angle of 60 degrees.

In one embodiment of the fifth aspect, the liquid container further comprises a circuit board connected to the container body adjacent the second portion of the container body, the circuit board having the plurality of emitter-receiver pairs disposed or mounted lengthwise along the circuit board; and a circuit module electrically connected with the plurality of emitter-receiver pairs.

In one embodiment of the fifth aspect, the second emitter-receiver pair is arranged at a lower half of the container body when the container is in an upright configuration.

In one embodiment of the fifth aspect, the second emitter-receiver pair is arranged below at least one of the one or more first emitter-receiver pairs when the container is in an upright configuration. Preferably, the second emitter-receiver pair is arranged below the one or more first emitter-receiver pairs when the container is in an upright configuration.

In one embodiment of the fifth aspect, the plurality of emitters and receivers are infrared emitters and infrared receivers adapted to emit and receive infrared signals; and wherein the first and second walls are infrared-transmissive, and the first and second walls are operable to alter a wave speed (and hence wavelength or travel direction) of the infrared signal. Preferably, the first and second walls are made of plastic materials.

In one embodiment of the fifth aspect, the one or more first emitter-receiver pairs are arranged to detect the amount of liquid in the container body based on the presence or absence of signal received at the corresponding receivers.

In one embodiment of the fifth aspect, the second emitter-receiver pair is arranged to detect the type of liquid contained in the container body based on a difference of signal strength between a signal emitted by the emitter and a signal received at the corresponding receiver.

In one embodiment of the fifth aspect, the liquid detector is operable to differentiate between water and coffee contained within the liquid container.

In one embodiment of the fifth aspect, the first portion defines a first volume and the second portion defines a second volume, the first and second volumes together the volume of the liquid container for receiving liquid, and the first volume being larger than the second volume.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figures 1A, 1B, 1C:
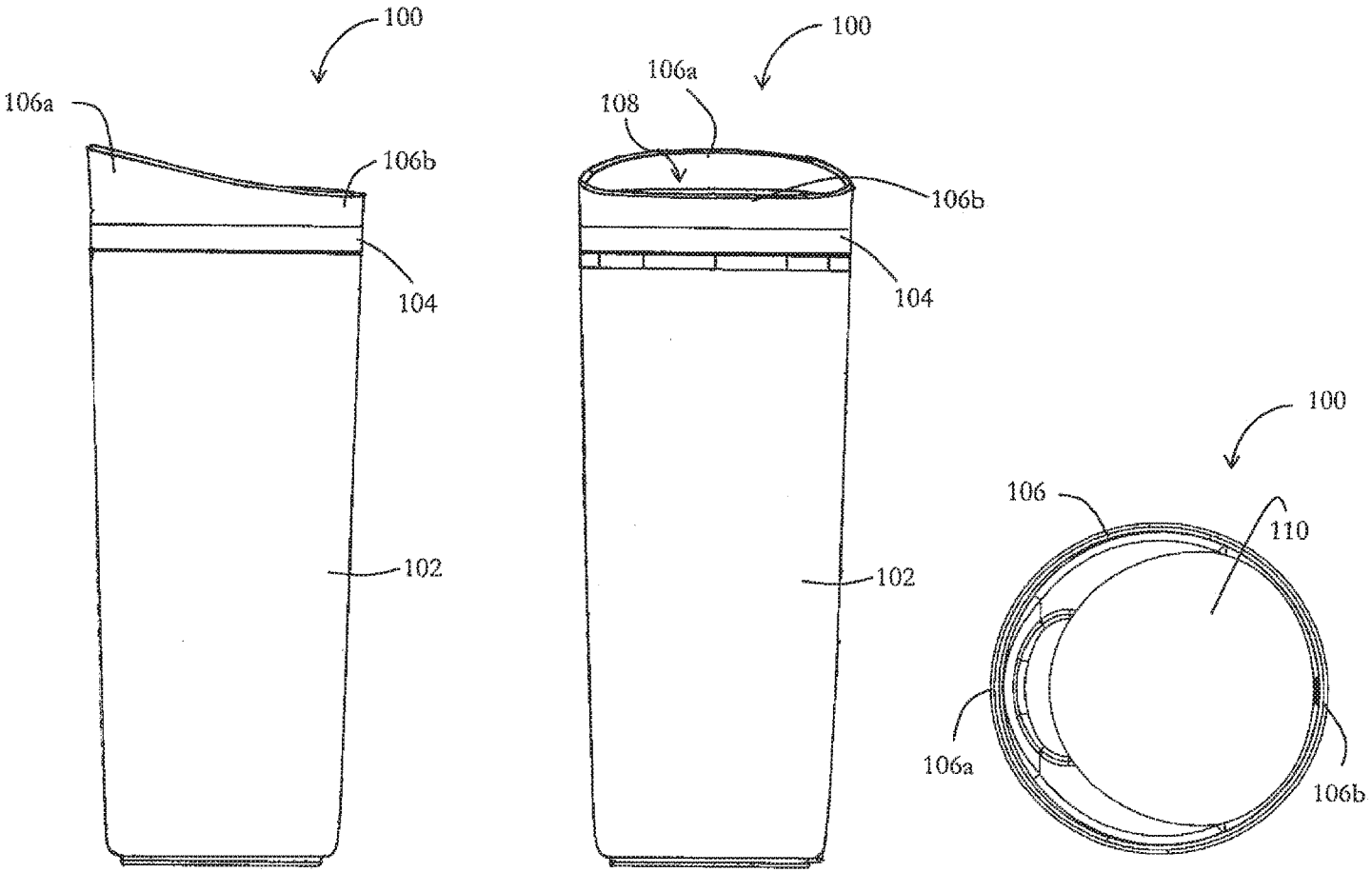
FIG. 1A is a side view of a beverage container in accordance with one embodiment of the present invention.
FIG. 1B is a side view of the beverage container of FIG. 1A.
FIG. 1C is a top view of the beverage container of FIG. 1A.

The concept of the Internet of Things (IoT) refers to a world in which everyday physical objects are embedded with sensors and actuators and are linked to the Internet through wired or wireless networks such that data can be readily gathered, communicated and analysed, and that events can be readily responded to with minimal human intervention. In the era of the Internet of Things (IoT), physical objects can represent themselves digitally in the physical world to interact with other objects, thereby transforming the physical world into a huge information system.

Three elements are particular important in the Internet of Things (IoT). The first element is sensors and actuators. These sensors and actuators enable different information about human activities and the environment to be gathered. Examples of these sensors and actuators include position sensors such as GPS that can provide location information; motion sensors such as gyroscope that can provide orientation information, etc. The second element is connection or connectivity. Connection refers to the ability to readily store data, such as those gathered by the sensors and actuators, onto networks. Examples of this include Bluetooth, RFID, Wi-Fi, 3G, 4G networks that can be used to connect to the Internet wirelessly. The third element is people and process, and this involves the utilization and integration of the gathered data on the networks into people, processes, and systems for improved decision making. These three elements play a crucial role in the development of new types of smart devices, systems, and applications.

Recently, new types of smart devices, systems, and applications have been developed based on the concept of the Internet of Things (IoT). Examples of these devices and systems include smart thermostats by Nest Labs and WeMo® smart switch by Belkin™ for home automation; Peak™ fitness and sleep tracker by Basis for monitoring and tracking fitness-related metrics, etc. To date, the development of new smart devices is mostly on objects that are originally already electrical in nature. There remains significant room for development of new types of smart devices for various applications, for example, in health-related applications, to transform ordinary objects into smart objects with improved utility and efficiency.

Referring to FIGS. 1A-4, there is provided a beverage container 100 comprising a container body 102, wherein the beverage container 100 includes a plurality of sensors arranged to determine information associated with liquid contained in the container body 102; and a processor operably coupled with the plurality of sensors for determining a beverage consumption routine of a user based on the information determined by the plurality of sensors. Preferably, the plurality of sensors are further arranged to determine one or more beverage consumption events or beverage filling events; and the processor is further arranged to determine the beverage consumption routine of a user of the beverage container 100 based on the one or more beverage consumption events or beverage filling events.

FIGS. 1A-1C show the side and top views of a beverage container 100 in accordance with one embodiment of the present invention. As shown in FIGS. 1A-1C, the beverage container 100 includes a container body 102 and a lid 104 removably coupled with the container body 102. The container body 102 has a frustoconical shape that tapers slightly towards the bottom of the container 100. The lid 104 of the container 100 is mounted at the top of the container body 102, and it has a shape that substantially conforms to tapering of the container body 102.

In the present embodiment, the lid 104 includes a wall 106 extending along its periphery. The peripheral wall 106 is continuous and it includes a raised portion 106*a* and a lowered portion 106*b*. The peripheral wall 106 defines a recess 108 in which the opening (not shown) of the lid 104 is formed. The opening formed on the lid 104 allows a user of the beverage container 100 to drink from the container body 102 with the lid 104 attached. Preferably, the opening of the lid 104 is arranged closer to the lowered portion 106*b* than to the raised portion 106*a*. In this way, when the user drinks from the container body 102, the lip of the user will be in contact with the lowered portion 106*b* of the peripheral wall 106 of the lid 104. As shown in FIG. 1C, the lid 104 further includes a pivotable lid member 110 that can be manipulated to open or close the opening of the lid 104. In the present embodiment, the lid member 110 is shown covering the opening formed on the lid 104.

Figure 2C:
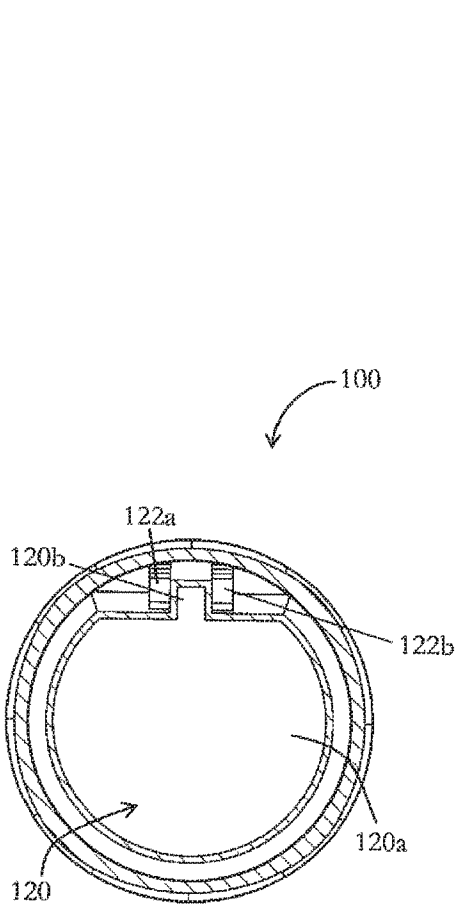
FIG. 2C is a cross sectional view of the beverage container of FIG. 2A taken along the line C-C of FIG. 2A.
Figure 2B:
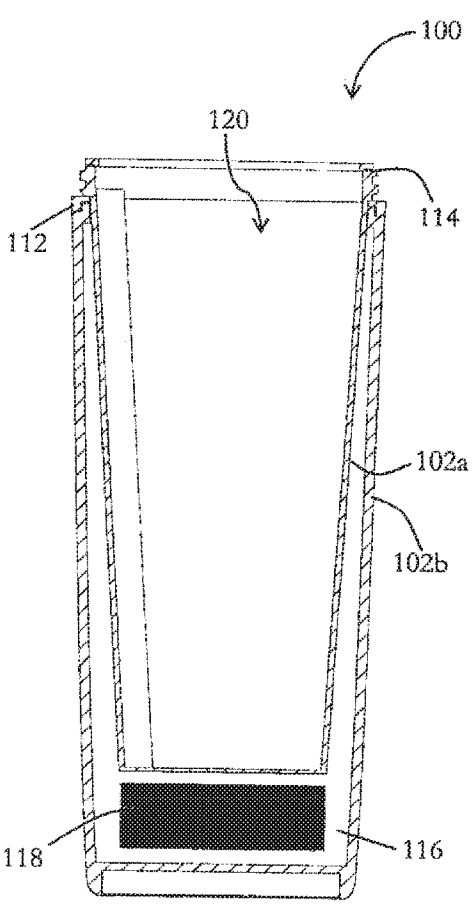
FIG. 2B is a cross sectional view of the beverage container of FIG. 2A taken along the line B-B of FIG. 2A.
Figure 2A:
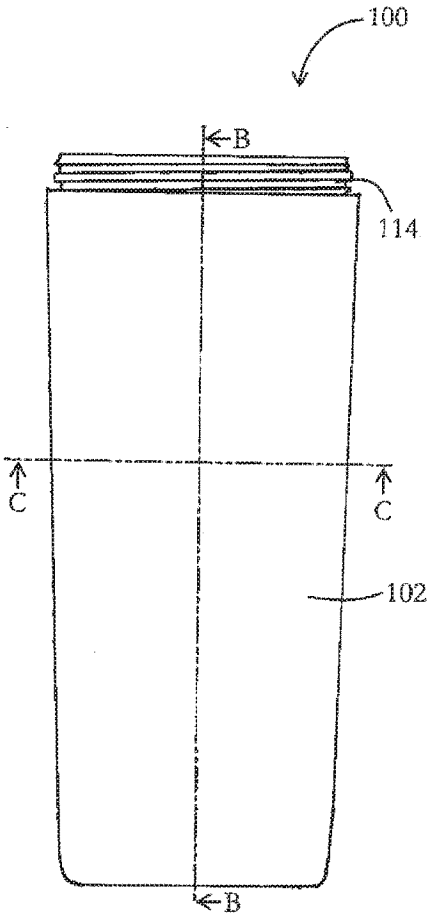
FIG. 2A is a side view of the beverage container of FIG. 1A with the lid removed.

FIG. 2A shows a side view of the beverage container 100 of FIG. 1A with the lid 104 removed; and FIGS. 2B and 2C show a cross sectional view of the beverage container 100 of FIG. 2A taken along lines B-B and C-C of FIG. 2A respectively. As best shown in FIG. 2B, the container body 102 includes an inner container body 102*a* arranged in an outer container body 102*b*. The inner and outer container bodies 102*a*, 102*b* are coupled with each other through a ring member 112 arranged at an upper end of the outer container body 102*b* to secure the inner container body 102*a* onto the outer container body 102*b*. In one embodiment, the inner and outer container bodies 102*a*, 102*b* may be further connected with each other using chemical or mechanical bonding means. For example, the inner and outer container bodies 102*a*, 102*b* may be connected together using adhesives or mechanical fittings such as snap fit, screw fit, etc.

In the present embodiment, the inner and outer container bodies 102*a*, 102*b* both taper towards the bottom of their respective body. In particular, the extent of tapering of the inner container body 102*a* is larger than that of the outer container body 102*b*. Accordingly, when the inner container body 102*a* is stacked or arranged inside the outer container body 102*b*, the upper end of the inner container body 102*a* protrudes upwards from the upper end of the outer container body 102*b*, and that the lower end of the inner container body 102*a* is raised relative to the lower end of the outer container body 102*b*. As shown in FIGS. 2A and 2B, the upper end of the inner container body 102*a* includes a threaded arrangement 114 for coupling with a corresponding threaded arrangement on the lid 104 such that the lid 104 can be removably screw-fitted with the container body 102. A chamber or space 116 is defined between the inner and outer container bodies 102*a*, 102*b*. An electronic circuit module 118 such as a PCB with a processor, sensors and/or other information handling modules can be arranged in the space 116. A power supply (not shown) may also be arranged in the space 116. In one embodiment, one or more data and power communication ports in electrical connection with any parts of the circuit module 118 or the power supply may be formed on the outer container body so as to enable data and power transmission between the beverage container 100 and an external electronic device or a power source.

Referring now to FIG. 2C, the cross section of a beverage chamber 120 defined by the inner container body 102*a* includes a major segment portion 120*a* in the shape of a major segment in a circle and a slot portion 120*b* that is rectangular. An array of level sensors 122 for detecting the level of liquid in the beverage chamber 120 are arranged adjacent the slot portion 120*b* away from the major segment portion 120*a*. In the present embodiment, each level sensor 122 in the array includes a transmitter 122*a* and an emitter 122*b*, and the transmitter 122*a* and the emitter 122*b* of any one level sensor 122 are arranged on substantially the same horizontal level relative to the bottom of the container 100. As shown in FIG. 2C, the transmitter 122*a* and the emitter 122*b* of the same level sensor 122 are arranged proximal each other in a non-diametrically opposed manner. Different level sensors 122 are arranged at different heights relative to the bottom of the container 100. In the present embodiment, by arranging the transmitter 122*a* and the emitter 122*b* of the same level sensor 122 non-diametrically in the same quadrant such that they are in close proximity to each other, the power that is required to operate the level sensors may be reduced, and the accuracy of measurement can be improved.

In one embodiment of the beverage container 100 (this embodiment is not illustrated in the Figures), a further detachable container body can be arranged inside the inner container body 102*a*. In this embodiment, the detachable container body may be used to carry beverage in place of the inner container body 102*a*. The detachable container body may be secured to the inner container body 102*a* through a snap fit arrangement (e.g., with a rib and groove type engagement formed on part of the outer surface of the detachable container body and the inner container body 102*a*), a screw fit arrangement (e.g., with screw threads formed on part of the outer surface of the detachable container body and the inner container body 102*a*) or any other types of mechanical or electromagnetic fittings (e.g., using magnets). In this arrangement, the detachable container body, once detached from the container 100, can be easily cleaned. Also, the use of the further detachable container body for carrying beverage could minimize the chance of disrupting or even damaging the circuits in between the inner and outer container bodies 102*a*, 102*b* during cleaning. In one embodiment, the detachable container body may also be made of materials that are suitable to be put into a dish washing machine for cleaning or washing. Accordingly, the user can use a dish washing machine to clean the detached detachable container, the only part that is arranged to carry beverage and hence needs to be cleaned.

In one embodiment of the beverage container 100 (this embodiment is not illustrated in the Figures), a heating element may be arranged between the inner and outer container bodies 102*a*, 102*b* for heating or at least maintaining the temperature of the beverage contained in the container 100. Preferably, the heating element is arranged adjacent or on the outer surface of the inner container body 102*a* so as to provide the most efficient heating effect. The heating element may be metallic (e.g., nichrome, platinum), ceramic (e.g., molybdenum disilicide), or other composite heating elements that is operable to convert electricity into heat through resistive heating. In one example, the heating element is a spiral coil wrapped around the outer surface of the inner container body 102*a*. In other embodiments, the heating elements may take any other forms, such as a block, a sheet, etc. In the present embodiment, the container 100 preferably includes a port (e.g., USB port) for receiving electricity from an external power source so as to heat up the heating element. In some embodiments, a resistive control may be provided to adjust the temperature of the heating element. By activating a heating element between the inner and outer container bodies 102*a*, 102*b*, the temperature of the beverage (especially hot beverage) can be maintained and even increased, thereby reduce heat loss to the beverage or even heat up the cooled beverage. A person skilled in the art would appreciate the proper heat insulation arrangement may be provided in the space 116 between the inner and outer container bodies 102*a*, 102*b* so that the heat generated by the heating element will not substantially propagate to the electronic arrangements also included in the space 116 to affect the operation of these electronic arrangements.

Figure 3:
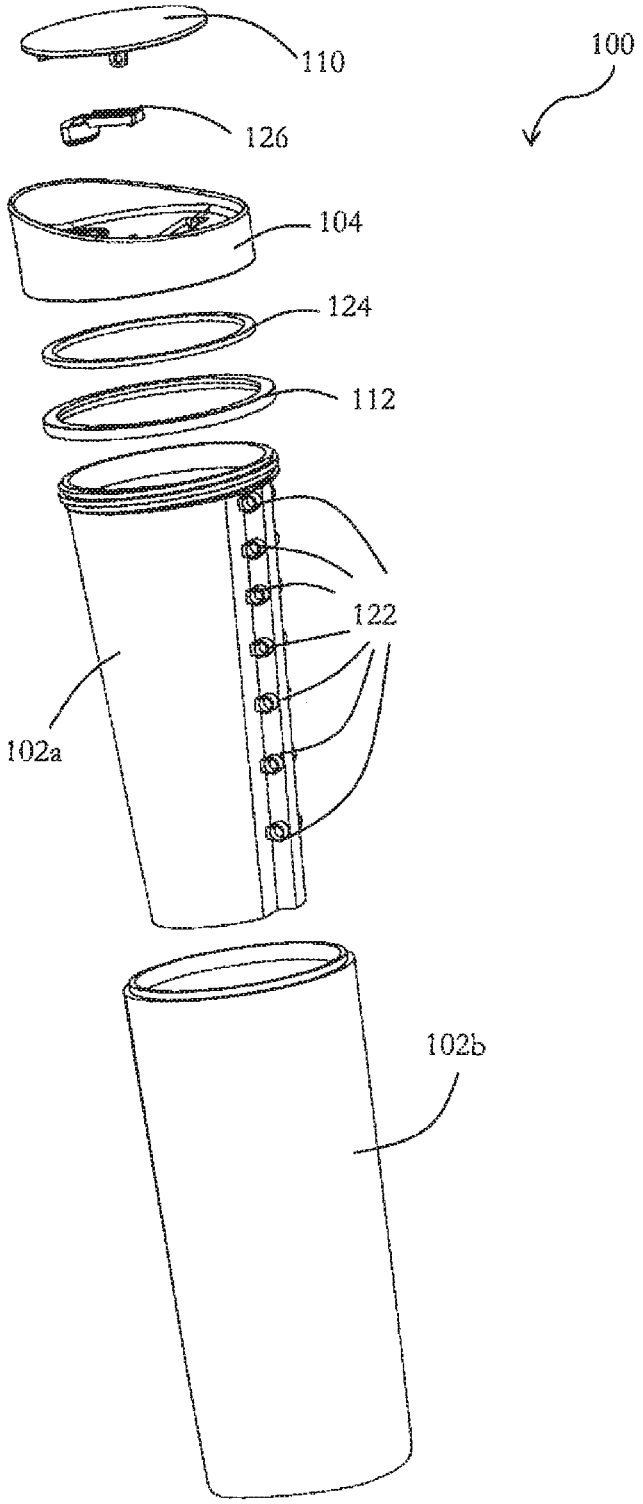
FIG. 3 is an exploded view of the beverage container of FIG. 1A.

FIG. 3 shows an exploded view of the beverage container 100 of FIG. 1A. For simplicity, the electronic circuit module 118 and other electrical arrangements of the container 100 are not shown in FIG. 3. As shown in FIG. 3, the container body 102 of the beverage container 100 includes the inner container body 102*a*, the outer container body 102*b*, and the ring member 112. The inner container body 102*a* in the present embodiment includes a linear array of level sensors 122 arranged at least partly lengthwise along the height of the inner container body 102*a* for detecting a level of the liquid in the inner container body so as to determine a volume of liquid in the container body 102. In one non-limiting example, the level sensor 122 closest to the bottom of the container body may indicate a water level of 50 ml, the level sensor second closest to the bottom of the container body may indicate a water level of 100 ml, etc., and that the level sensors are operable to measure a volume of up to 500 ml. In the present embodiment, the level sensors 122 are not spaced equally apart along the length of the container body, as the inner container body is tapered towards the bottom of the container and the volume measured by any two adjacent level sensors is chosen to be the same.

With continuous reference to FIG. 3, the lid 104 of the beverage container 100 includes the lid 104 with an opening, a seal ring 124, and a pivotable lid member 110. In the present embodiment, the seal ring 124 is attached or coupled to a threaded arrangement (not shown) arranged on an inner peripheral surface at the underside of the lid 104. The threaded arrangement on an inner peripheral surface at the underside of the lid 104 is arranged to engage with the threaded arrangement 114 formed at the upper end of the inner container body 102*a*. When the lid 104 is screwed onto the container body 102 so that the two threaded arrangements engage with each other, the seal ring 124 is arranged between the threaded arrangement of the lid 104 and the threaded arrangement 114 of the container body 102. The seal ring 124 prevents spillage or leakage of heat or beverage and ingress of dust or dirt. Preferably, the pivotable lid member 110 is coupled with the lid 104 through a coupling member 126. A lock (not shown) may be arranged in the lid 104 to secure the lid member 110 in place, maintaining the lid member 110 in the closed position that closes the opening formed on the lid 104, when the beverage container 100 is not used by the user.

The beverage container 100 shown in FIGS. 1A-3 and described above is a preferred embodiment of the present invention. It should be appreciated that the beverage container, in some alternative embodiments, can be of other shape and designs, for function, ergonomic or aesthetics reasons. The beverage container is also capable of other modifications. For example, a hand grip region with increased friction can be provided on a surface of the outer container body 102*b* to facilitate gripping of the container 100. On the other hand, the beverage container 100 in the present invention can be made of any suitable materials such as one or more of plastic, glass, metal, glass etc. Without limiting the invention, it is preferred that the container body 102 is made of heat insulating material for minimizing heat conduction between the fluid in the container body 102, the container body 102, and the environment, thereby maintaining the temperature of the fluid contained in the container body 102 at a substantially constant level for a relatively long period of time.

Figure 11:
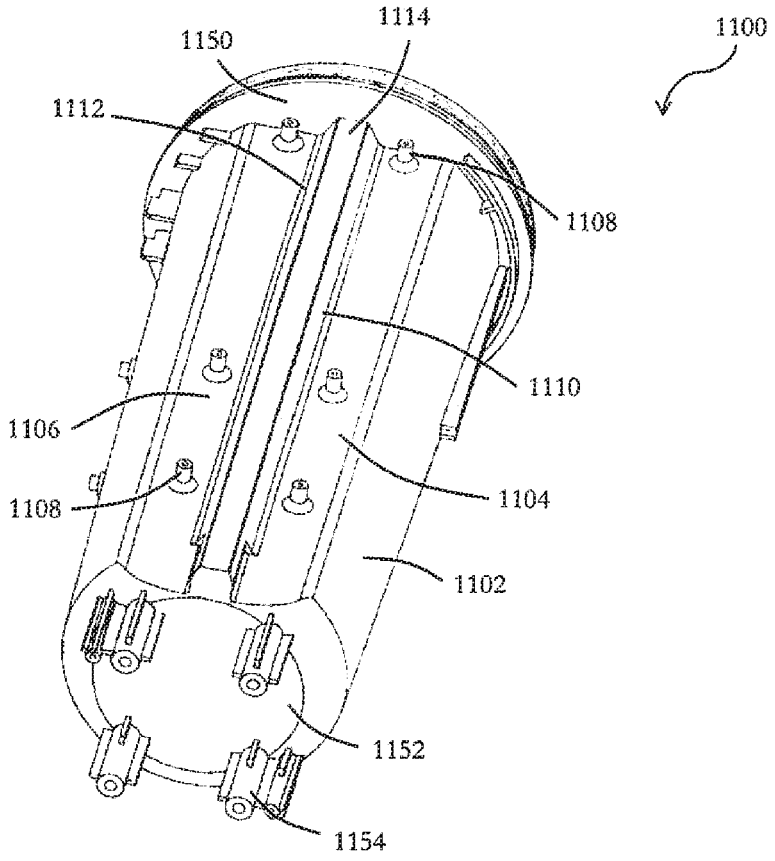
FIG. 11 is a perspective view of a liquid container in accordance with one embedment of the present invention.

Referring now to FIGS. 11-13B, there is provided a liquid container 1100 comprising: a container body with a first portion (1102, 1104, 1106) and a second portion (1110, 1112, 1114) continuous with the first portion, the first and second portions together define a volume for receiving liquid; a plurality of emitters 1120 and receivers 1122 forming emitter-receiver pairs arranged external to the second portion (1110, 1112, 1114) of the container body and spaced apart along a lengthwise direction of the second portion (1110, 1112, 1114) of the container body; the emitter 1120 of each of the plurality of emitter-receiver pairs is arranged to transmit a signal towards the corresponding receiver 1122 of the plurality of emitter-receiver pairs through the second portion (1110, 1112) of the container body; wherein the plurality of emitter-receiver pairs include: one or more first emitter-receiver pairs forming level sensors for detecting an amount of liquid in the container body; and a second emitter-receiver pair forming a liquid detector for detecting a type of liquid contained in the container body. In a preferred embodiment of the present invention, the liquid container 1100 as shown in FIG. 11 is used as the inner container body 102*a* as described with respect to FIGS. 1-3B. In other embodiments, the liquid container 1100 as shown in FIG. 11 may be used alone, or part of a liquid container.

As shown in FIG. 11, the liquid container 1100 includes a container body with a first portion and a second portion continuous with the first portion. Preferably, the first portion defines a first volume and the second portion defines a second volume larger than the first volume. The first and second volumes together define the total volume of the liquid container. The first portion of the container body includes a C-shaped curved wall portion 1102, and two substantially flat wall portions 1104, 1106 continuous with and extending from two ends of the C-shaped curved wall portion 1102. The two substantially flat wall portions 1104, 1106 are arranged generally parallel, and are extending towards but without touching each other. Preferably, a number of posts 1108 are arranged on the two substantially flat wall portions 1104, 1106 for mounting, for example, a circuit board (not shown) to the container body. The second portion of the container body includes a first wall 1110 and a second wall 1112 extending from and continuous with the respective substantially flat wall portions 1104, 1106; and a third wall 1114 continuous with and extending between the first and second walls 1110, 1112. In a preferred embodiment, the third wall 1114 is generally parallel to the two flat wall portions 1104, 1106. The first and second walls 1110, 1112 are preferably planar, and they generally extend from the respective substantially flat walls 1104, 1106 at an angle. In the present embodiment, an upper portion of the first and second walls 1110, 1112 (spanning the length across all posts 1108) is arranged at an angle of less than 90 degrees with each other; and a lower portion of the first and second walls 1110, 1112 is arranged substantially parallel to each other. Preferably, the upper portion of the first and second walls 1110, 1112 is arranged at an angle between 45-75 degrees. More preferably, the upper portion of the first and second walls 1110, 1112 is arranged at an angle of 60 degrees. In the present embodiment, the container body further includes an annular flange rim 1150 arranged at a top part of the container body for connecting the first and second portions. The bottom part of the container body also includes a bottom wall 1152 connecting the first and second portions of the container body. Optionally, a number of perpendicularly extending posts 1154 are arranged on the bottom wall 1152 for raising the container body, for mounting the container body to another structure, and/or for defining a space for housing other components (e.g., circuit modules, processors, batteries, etc.), when the container body is arranged in a upright configuration and/or mounted with another structural member.

In the present embodiment, a plurality of emitters 1120 and receivers 1122 (shown in FIGS. 12A, 12C, 13A and 13B, but not in FIG. 11) forming emitter-receiver pairs may be arranged external to the second portion of the container body. The emitter-receiver pairs are preferably spaced apart along a lengthwise direction of the second portion of the container body, similar to that shown in FIG. 3. In the present embodiment, the plurality of emitter-receiver pairs are preferably arranged adjacent the first and second walls 1110, 1112 such that the first and second walls 1110, 1112 are disposed between the emitter 1120 and the receiver 1122 of each emitter-receiver pair, as shown in FIGS. 12A, 12C, 13A and 13B. The emitter 1120 of each emitter-receiver pair is arranged to transmit a signal towards the corresponding receiver 1122 through the first and second walls 1110, 1112 of the second portion of the container body. Preferably, one or more emitter-receiver pairs disposed adjacent the upper portion of the first and second walls 1110, 1112 are arranged to function as level sensors for detecting an amount of liquid in the container body; and one or more emitter-receiver pairs disposed adjacent the lower portion of the first and second walls 1110, 1112 are arranged to function as a liquid detector for detecting a type of liquid contained in the container body. Details of the operation of these emitter-receiver pairs will be described in further detail below. In one embodiment, the one or more emitter-receiver pairs that function as a liquid detector are arranged at a lower half of the container body, when the container body is in an upright configuration. In a preferred embodiment, the emitter-receiver pair that functions as a liquid detector is arranged below at least one of the emitter-receiver pairs that function as level sensors, when the container body is in an upright configuration. More preferably, the emitter-receiver pair that functions as a liquid detector is arranged below all of the emitter-receiver pairs that function as level sensors, when the container body is in an upright configuration.

In the present embodiment, the emitters 1120 and receivers 1122 are infrared emitters and infrared receivers adapted to emit and receive infrared signals; and the first and second walls 1110, 1112 are infrared-transmissive such that infrared light emitted by the emitters 1120 may pass through the first and second walls 1110, 1112 to reach the receivers 1122. In the present embodiment, the first and second walls 1110, 1112 are made of plastic materials, and they are operable to alter a wave speed (and hence wavelength, or even travel direction) of the infrared light ray passing therethrough based on Snell's law of refraction.

Figure 12A:
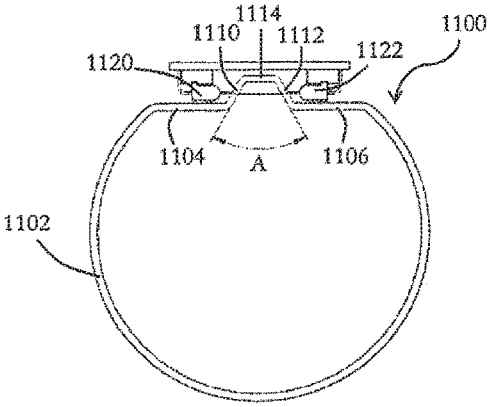
FIG. 12A is a cross sectional view taken at a certain height of an upper portion of the liquid container of FIG. 11, with no liquid reaching that height.
Figure 12B:
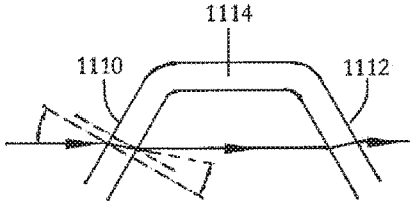
FIG. 12B is a ray diagram showing the travel of light rays in the cross sectional view of FIG. 12A.

FIG. 12A shows a cross sectional view of the container body mounted with the circuit board, taken at the upper portion of the first and second walls 1110, 1112 of FIG. 11, with no liquid reaching that height. As shown in FIG. 12A, the infrared emitter 1120 and infrared receiver 1122 are arranged adjacent the first and second walls 1110, 1112 of the second portion of the container body. In this example, the first and second walls 1110, 1112 are arranged at an angle of 60 degrees. The infrared emitter 1120 is arranged to emit an infrared light beam towards the infrared receiver 1122. As shown in the corresponding ray diagram of FIG. 12B, as no liquid has reached the height of the cross section, infrared light emitted from the emitter 1120 firstly enters into the first wall 1110 (denser medium) from air (less dense medium), thereby undergoing refraction by bending towards a normal. Upon leaving the first wall 1110, the light ray undergoes a second refraction, this time bending away from normal as it travels from the first wall 1110 (denser medium) to air (less dense medium). As a result, the light ray resumes a traveling direction substantially parallel to the initially emitted light ray. Likewise, upon reaching the second wall 1112, the light ray undergoes refraction by firstly bending towards a normal. When leaving the second wall 1112, the light ray undergoes refraction by bending away from a normal, thereby resuming a traveling direction substantially parallel to that of the initial light ray emitted from the emitter 1120. At the end, the light ray reaches the receiver 1122, and is thus detected by the receiver 1122.

Figure 12C:
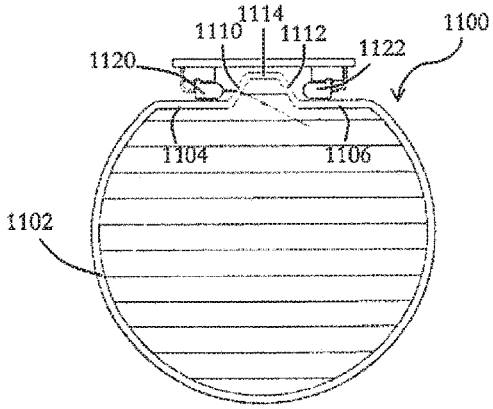
FIG. 12C is a cross sectional view of the upper portion of the liquid container of FIG. 11 taken along the same height as FIG. 12A, with liquid reaching that height.
Figure 12D:
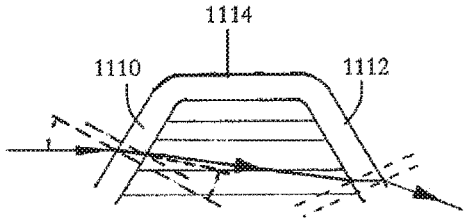
FIG. 12D is a ray diagram showing the travel of light rays in the cross sectional view of FIG. 12C.

FIG. 12C shows a cross sectional view of the container body mounted with the circuit board, taken at the upper portion of the first and second walls 1110, 1112 of FIG. 11 at the same position as FIG. 12A. The only difference between FIGS. 12A and 12C is that in FIG. 12C there is liquid reaching the illustrated height. As shown in corresponding ray diagram of FIG. 12D, in this example, the initial light ray emitted by the emitter 1120 firstly enters into the first wall 1110 (denser medium) from air (less dense medium), undergoing refraction by bending towards a normal. Upon leaving the first wall 1110, the light ray undergoes a second refraction, this time bending away from normal as it travels from the first wall 1110 (denser medium) to the liquid (less dense medium) contained in the container. However, since liquid in FIG. 12C has a higher refraction index compared with air in FIG. 12A, the light ray exiting the first wall 1110 in FIG. 12C can no longer resume a traveling direction substantially parallel to the initially emitter light ray. Later, upon reaching the second wall 1112, the light ray undergoes refraction by firstly bending towards a normal. When leaving from the second wall 1112, the light ray undergoes another refraction, this time bending away from the normal. As shown in FIG. 12D, the light ray leaving the second wall 1112 travels in a direction that deviates even more from the traveling direction of the initial light ray emitted from the emitter 1120. As a result, the light ray in FIG. 12C cannot reach the receiver.

Based on the illustration of FIGS. 12A-12D, it can be readily appreciated that the arrangement of emitter-receiver pairs at the upper portion of the first and second walls 1110, 1112 of the second portion of the container body allow detection of the amount of liquid in the container body based on the presence or absence of signal received at the corresponding receivers 1122. More particularly, if a receiver 1122 fails to receive a signal from the emitter 1120, it indicates that liquid has already reached that particular level which corresponds to the height of the particular emitter-receiver pair. In one embodiment, by properly programming the circuit module on the circuit board (that is in connection with the emitter-receiver pairs), the amount of liquid contained in the container body can be readily determined. In the present embodiment, the more/denser the emitter-receiver pairs are arranged along the length of the second portion, the higher degree of measuring accuracy can be achieved.

Figure 13A:
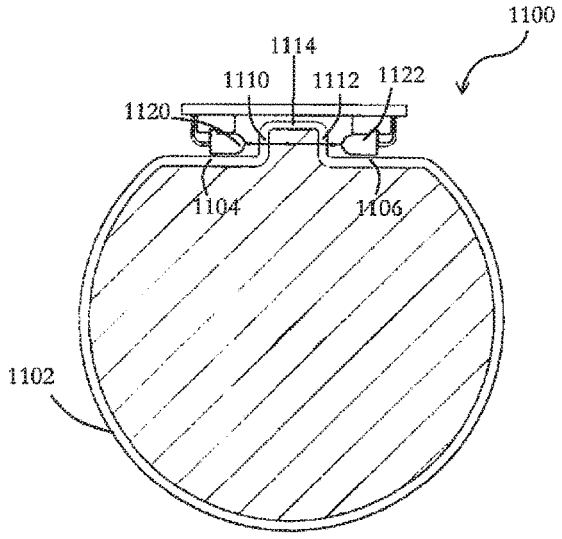
FIG. 13A is a cross sectional view taken at a certain height of a lower portion of the liquid container of FIG. 11, with a first type of liquid reaching that height.
Figure 13B:
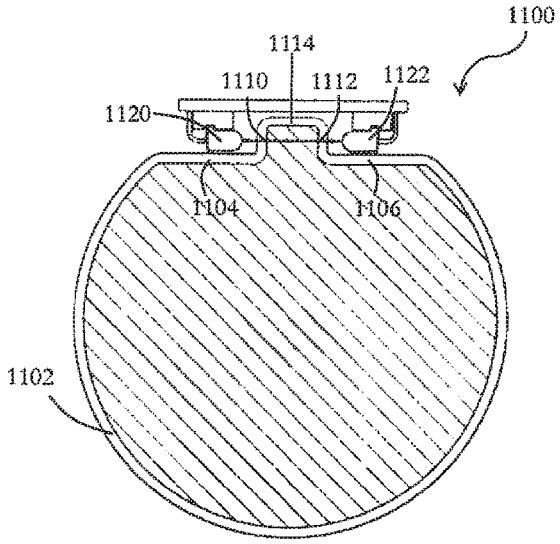
FIG. 13B is a cross sectional view of the lower portion of the liquid container of FIG. 11 taken at the same height as FIG. 13A, with a second type of liquid reaching that height.

FIGS. 13A-13B each show a cross sectional view of the container body mounted with the circuit board, taken at the lower portion of the first and second walls 1110, 1112 of FIG. 11. The structural arrangement of FIGS. 13A and 13B are identical, the only difference being that in FIG. 13A, a first type of liquid (e.g., water) is contained in the container body whereas in FIG. 13B, a second type of liquid (e.g., coffee) is contained in the container body. As shown in FIGS. 13A and 13B, the light ray emitted by the emitter 1120 enters and then leaves the first wall 1110, and subsequently enters and then leaves the second wall 1112, reaching the receiver 1122. In FIGS. 13A and 13B, the light rays travel in a substantially linear manner. This is because the light ray is always parallel to a normal of the first wall 1110, and a normal of the second wall 1112. Although there is no change in travelling direction, the light ray does experience change in wavelength and wave speed as it travels across different transmission medium (air, liquid, plastic, etc.). The emitter-receiver pair arranged in FIGS. 13A and 13B is operable to detect the type of liquid contained in the container body based on a difference of signal strength between a signal emitted by the emitter 1120 and a signal received at the corresponding receiver 1122. For example, when the liquid contained in the container body is water (no colour), the light ray may experience less attenuation as it travels from the emitter 1120 to the receiver 1122 through the first and second walls 1110, 1112, resulting in a relatively high intensity signal received at the receiver 1122; and when the liquid contained in the container body is coffee (coloured), the light ray may experience more attenuation as it travels from the emitter 1120 to the receiver 1122 through the first and second walls 1110, 1112, resulting in a relatively low intensity signal received at the receiver 1122. Based on this difference in intensity level of light ray received at the receiver 1122, different voltages corresponding to different intensity differences may be generated by the circuit board. In one embodiment, by properly programming the circuit module on the circuit board (that is in connection with the emitter-receiver pairs), the type of liquid contained in the container body can be readily differentiated based on the amplitude of the resulting voltage signal.

A person skilled in the art would readily appreciate that the container body of the liquid container 1100 of the present embodiment may take different shapes and forms, without deviating from the scope of the present invention. As long as the emitters-receivers and the first and second walls arrangement of the container body are operable, the other structures of the container body can be suitably altered. Also, other types of emitters and receivers (non-infrared based) may be used in the present invention, as long as the first and second walls of the second portion of the container body remain transmissive.

In the present embodiment, the construction of the second portion of the container body and the use of different emitter-receiver pairs for level sensing and for liquid detection are particularly advantageous. By arranging different emitter-receiver pairs for different purposes, the complexity of the circuitry of the circuit board can be substantially reduced. Also, by arranging the first and second walls of the second portion of the container body differently (some at angles with each other, some parallel with each other) for different sensing purposes, the emitter-receiver pairs need not contain delicate or advanced electronic components, and this results in substantial reduction of manufacture cost without sacrificing quality and reliability. By relying on refractive phenomena instead of purely electrical measurements for determining liquid level and liquid type, the container arrangement in the present embodiment may be less prone to electronic failures of the circuit board.

Figure 4:
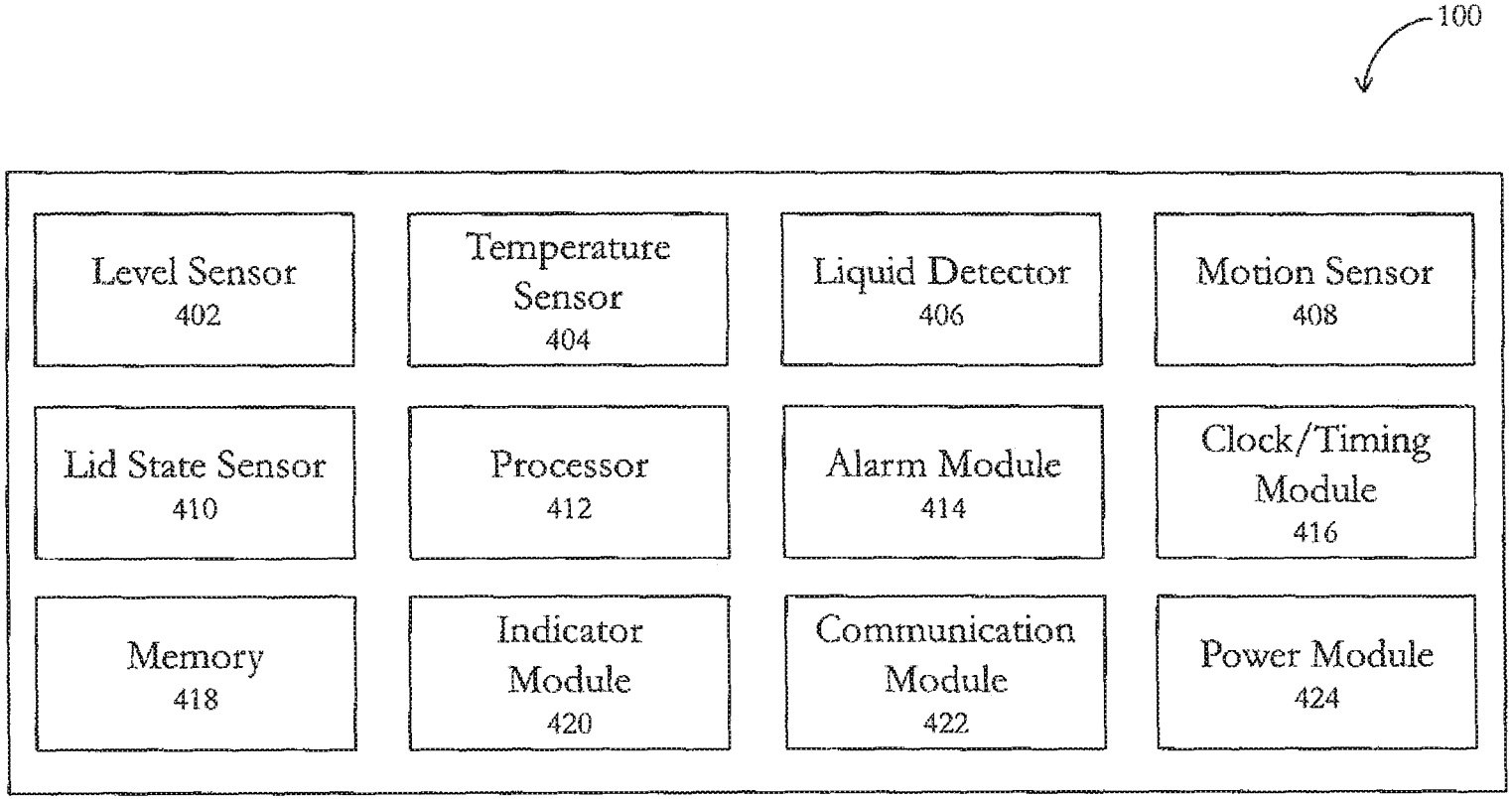
FIG. 4 is a functional block diagram of the beverage container of FIG. 1A in accordance with one embodiment of the present invention.

FIG. 4 shows a functional block diagram of the beverage container 100 of FIG. 1A in accordance with one embodiment of the present invention. Although the specific implementations and arrangement of these functional modules in the beverage container 100 are not illustrated, it should be appreciated that these functional modules can be implemented using different electrical or mechanical components arranged in appropriate positions in the beverage container 100, e.g., in the space between the inner and outer container bodies 102*a*, 102*b*, on the lid 104, on the surface of the beverage container 100, etc.

The beverage container 100 in the present embodiment as illustrated in FIG. 4 is a smart beverage container that is operable to determine information related to the liquid contained in the container body 102, such as the amount of fluid, the type of fluid, and the temperature of the fluid contained in the beverage container 100. This is achieved by arranging a level sensor 402, a temperature sensor 404, and a liquid detector 406 in the beverage container 100 in the present embodiment as shown in FIG. 4.

The level sensor 402 in the beverage container 100 of the present embodiment refers to the array of level sensors 122 arranged lengthwise along the height of the container body 102 (at different height of the container body 102) as shown in FIG. 3. As previously described, the level sensors 122 are arranged adjacent the slot portion 120*b* of the beverage chamber 120, and each level sensor 122 includes an infrared transmitter 122*a* and an infrared emitter 122*b* arranged in a pair at the same height. Preferably, the transmitter 122*a* and the emitter 122*b* of the same level sensor 122 are arranged opposite each other non-diametrically such that they are in close proximity to each other for improved measurement accuracy and power conservation. Different level sensors 122 (pairs of infrared transmitters and emitters) are arranged at different height of the container 100 to determine the volume of liquid in the beverage chamber 120. In one example, the level sensors 122 (transmitters 122*a* and emitters 122*b*) are operable to compare the intensity or time differences of the infrared light emitted and received, and determine whether the liquid has reached the level of a particular level sensor 122. In the present embodiment, the more the number of level sensors used, the more accurate the volume measurement would be. It should be noted that in other embodiments, the level sensor 402 may be based on other optical, electrical, or acoustical means, and any number of level sensors may be used.

The temperature sensor 404 of the beverage container 100 in the present embodiment is for determining a temperature of the liquid contained in the container body 102. In one embodiment, the temperature sensor 404 may be arranged at least partly on or adjacent the bottom surface of the inner container body 102*a* such that it is immediately adjacent or in contact with the liquid in the inner container body 102*a*. In the present embodiment, the temperature sensor 404 is a thermistor that can measure temperature in the range of 0° C.-100° C. However, in other embodiments, the temperature sensor 404 may be other mechanical or electrical temperature sensing devices such as a thermocouple, and the temperature that can be measured may be beyond the range of 0° C.-100° C.

The liquid detector 406 in the beverage container 100 is arranged to detect the type of the liquid contained in the container body 102. With the liquid detector 406, the beverage container 100 is operable to differentiate that type of liquid contained in the container 100. Preferably, the liquid detector 406 is arranged in a lower part of the container body 102 such that the detection can be carried out even if the volume of liquid in the container 100 is small. In the present embodiment, the liquid detector 406 may comprise an infrared transmitter and an infrared emitter arranged on the inner container body 102*a* for detecting the type of liquid based on the intensity or time difference of the infrared light emitted and received. In one embodiment, the infrared transmitter and an infrared emitter of the liquid detector 406 may be one of those of the level sensors, i.e., at least one set of infrared transmitter and emitter is used to measure the level of liquid and the type of liquid at the same time. In other embodiments, the infrared transmitter and an infrared emitter of the liquid detector 406 may be separately arranged. In the present embodiment, the liquid detector 406 (infrared transmitter and an infrared emitter) is arranged to produce a voltage difference based on the intensity or time difference determined. As different types of liquid may have different colour and hence different light absorption, reflective or transmission properties, different voltage differences may be generated by the liquid detector 406, allowing these different fluids to be differentiated. In a preferred embodiment, the liquid detector 406 is adapted to differentiate whether the liquid in the container 100 is water or coffee based on the value of the voltage difference. It should be appreciated that other types of liquid detectors such as those using chemical based methods can also be used in the present invention. For chemical based liquid detectors, it may further be possible to detect the particular nutritional information of the liquid contained in the container 100.

Apart from the ability to determine information relating to the fluid in the container 100 as illustrated above, the beverage container 100 in the present embodiment is also operable to determine a beverage consumption event and a beverage filling event of the container 100. In other words, the beverage container 100 in the present embodiment is operable to detect that the user is drinking from the container 100 and that the user is filling the container 100 with liquid. To achieve this, the beverage container 100 in the present embodiment includes a motion sensor 408 and a lid state sensor 410.

The motion sensor 408 in the beverage container 100 in the present embodiment is arranged to detect and/or differentiate different motions of the beverage container 100. In one embodiment, the motion sensor 408 includes one or more of an accelerometer, a gyroscope, and a magnetometer. These accelerometer, gyroscope, and/or magnetometer are preferably arranged in the space defined between the inner and outer container bodies 102*a*, 102*b*. Preferably, the motion sensor 408 can detect manipulation of the beverage container 100 by the user based on the movement and orientation of the container 100. In one embodiment, the motion sensor 408 is operable that the container 100 is being picked up by the user for drinking and that the container 100 is being picked up by the user for filling liquid into the container 100, based on the specific movement and orientation of the container 100. In doing so, the motion sensor 408 is operable to exclude other types of manipulation of the beverage container 100 by the user (e.g. stirring, washing the container 100, etc.).

The lid state sensor 410 in the present embodiment is operable to detect if the lid member 110 is opened or closed. In other words, the lid state sensor 410 is operable to determine if the opening formed on the lid 104 is being accessed. In one embodiment, the lid state sensor 410 is further operable to determine if the lid 104 is connected with or disconnected from the container body 102. In the present embodiment, the lid state sensor 410 in the present embodiment is preferably a magnetic switch element operably associated with the lid member 110 and/or the lid 104, although other forms of lid state sensors 410 may also be implemented to operate with the present embodiment of the beverage container 100. These alternative examples of lid state sensors 410 may include, for example, mechanical or limiting switches to detect the open or close state of the lid or the position of the lid or other forms of electro-mechanical mechanism which can be actuated when the lid is manipulated by a user and in turn provide an electrical signal representative of the user's manipulation of the lid.

In the present embodiment, the beverage container 100 further includes a processor 412 that is operably connected with all other functional modules in the beverage container 100. In one embodiment, the processor 412 may be arranged in a circuit housed in the space 116 between the inner and outer container bodies 102*a*, 102*b*. The processor 412 in the present embodiment is arranged to receive information related to the volume, temperature, and type of liquid contained in the beverage container 100 from the level sensor 402, the temperature sensor 404, and the liquid detector 406; and receive motion data and lid state data from the motion sensor 408 and the lid state sensor 410.

In the present embodiment, the processor 412 is operable to determine the volume, temperature, and type of liquid contained in the beverage container 100. In one example of volume determination, assuming the first bottom level sensor 122 is arranged at a level indicting 50 ml of liquid is contained in the container 100 and the second bottom level sensor 122 is arranged at a level indicting 100 ml of liquid is contained in the container 100, if the processor detects that the first bottom level sensor 122 is activated and the second bottom level sensor 122 is not, it can determine that a liquid of 50-100 ml is contained in the container 100. On the other hand, the temperature of the liquid contained in the container 100 can be readily obtained from the temperature sensor 404. With respect to the determination of the type of liquid contained in the container 100, the processor 412 can be preprogrammed to associated different types of liquid with different measurement values such that the processor 412 can recognize the type of liquid in the container based on the voltage difference produced by the liquid detector 406. In the embodiment where a chemical based liquid detector is used, the processor 412 is further operable to perform a more complex analysis on the fluid contained in the container 100 based on the detection result to determine the composition of the liquid.

Furthermore, the processor 412 in the present embodiment is operable to determine the occurrence of beverage consumption event and a beverage filling event at the container 100 based on both the lid state detected by the lid state sensor 410 and the motion detection result of the motion sensor 408. For example, the processor 412 may determine that a beverage consumption event has occurred if the lid state sensor 410 determines that the lid 104 is opened and the motion sensor 408 detects that the beverage container 100 is being picked up in a particular manner. As a further example, the processor 412 may determine that a beverage filling event has occurred if the lid state sensor 410 determines that the lid 104 has disengaged from the container body 102 and that the motion sensor 408 detects that the beverage container 100 is being picked up in a particular manner. In one embodiment, the processor 412 may further be operable to exclude other events, such as a container washing event or a stirring event, based on the lid state detected by the lid state sensor 410 and the motion detection result of the motion sensor 408. Preferably, the processor 412 is also operable to determine the event in which the user discards or decants the fluid from the beverage container 100 without consuming it, based on both the lid state detected by the lid state sensor 410 and the motion detection result of the motion sensor 408. It should be appreciated that other ways for determining a beverage consumption event and a beverage filling event may also be possible in other embodiments.

In the present invention, the processor 412 is further operable to determine a beverage consumption routine of a user of the container 100 based on the information relating to the liquid contained in the beverage container 100, and the occurrence of the beverage consumption event and the beverage filling event. In the present embodiment, the beverage consumption routine includes one or more of the type of liquid consumed by the user, the type of liquid filled in by the user, the volume of liquid consumed by the user, the volume of the liquid filled in by the user, and time and/or duration of which the above events occurred. The beverage consumption routine may further include a log of all of the activities associated with the container 100.

Based on the beverage consumption routine of the user, the processor 412 is operable to generate a beverage consumption alarm to remind the user of the need to consume liquid from the beverage container 100. In one example, the processor 412 determines that the user should consume a certain amount of fluid for a particular day in order to remain hydrated. The processor 412 then creates the beverage consumption alarm based on the beverage consumption history of the user (e.g., the amount of beverage consumed in a certain time period, time since last consumption, type of beverage consumed, etc.), and optionally, the personal information of the user (e.g., weight, height, and age of the user).

The beverage consumption alarm will be conveyed to the user by appropriate means at a time determined by the processor 412, so as to remind the user that he/she should consume some fluid from the container 100 to remain hydrated.

As shown in FIG. 4, the beverage container 100 in the present embodiment further includes an alarm module 414 operably coupled with the processor 412. The alarm module 414 is arranged to provide the beverage consumption alarm to the user. In one embodiment, the alarm module 414 may comprise light emitting devices (e.g. LEDs) that are operable to provide a visible alarm, a vibrator (e.g., vibration motor) that is operable to provide a tactile alarm, a sound emitting device (e.g., buzzer) that is operable to provide an audible alarm, or a combination of these implements.

In one particular example, the alarm module 414 may comprise three surface-mount-device light-emitting diodes (SMD LED) of different colour (e.g., red, blue, green) and a vibration motor. In this example, when the processor 412 determines that the user has not consumed any beverage from the container 100 for 1 hour, it may produce a first beverage consumption alarm to remind the user, causing the alarm module 414 to flash the blue LED for 10 seconds and vibrate the vibration motor at the same time. If the processor 412 determines that the user has not consumed any beverage from the container 100 for 1.5 hour, it may produce a second beverage consumption alarm to remind the user, causing the alarm module 414 to flash the green LED for 10 seconds and vibrate the vibration motor at the same time. If the processor 412 determines that the user has not consumed any beverage from the container 100 for 2 hours, it may produce a third beverage consumption alarm to remind the user, causing the alarm module 414 to flash the red LED for 10 seconds and vibrate the vibration motor at the same time.

A clock/timing module 416 operably connected with the processor 412 is provided in the beverage container 100 of the present embodiment. In one example, the clock/timing module 416 may be arranged in a circuit disposed between the inner and outer container bodies 102*a*, 102*b*. Preferably, the clock/timing module 416 is arranged to provide the time of occurrence or duration of an event detected by the sensors to the processor 412. For example, the clock/timing module 416 may associate the beverage consumption event with the time of which it occurred, or associated a certain measurement (liquid level, temperature or type) or detection result with time. The clock/timing module 416 may also operate to provide a clock to the beverage container 100. Furthermore, it may help the processor 412 to determine the appropriate time for providing the beverage consumption alarm to the user.

In the present embodiment, the beverage container 100 further includes a memory module 418. In one example, the memory module 418 may be a RAM chip arranged in a circuit disposed between the inner and outer container bodies 102*a*, 102*b*. The memory module 418 is operably coupled with the processor 412, and optionally with one or more of the sensors and detectors, so as to maintain a local record of the beverage consumption events or beverage filling events, the information determined by the plurality of sensors, the beverage consumption routine of the user, the beverage consumption alarm schedule, as well as the time and/or duration associated with these events and results.

An indicator module 420 is arranged in the beverage container 100 in the present embodiment. The indicator module 420 is operably coupled with the processor 412, and optionally with one or more of the sensors and detectors, for indicating information relating to the liquid in the container body 100 to the user, or for indicating the status of the container 100 to the user. Preferably, the indicator module 420 is operable to indicate the temperature, the volume, and the type of liquid contained in the container body 102, the status of the memory module 418, the energy capacity remaining in the container 100, etc. In the present invention, the indicator module 420 may comprise a digital display screen, a light emitting device, a vibrator, a sound emitting device, surface markings on the container body 102, or a combination of these devices. These devices may be the same as those of the alarm module 414, or may be implemented at least partly separately.

In one particular example, the indicator module 420 comprises three surface-mount-device light-emitting diodes (SMD LED) of different colour (e.g., red, blue, green) and a vibration motor. In this example, when the processor 412 determines through the motion sensor 408 that the container 100 is picked up properly by the user, it may cause the temperature sensor 404 to measure the temperature of liquid in the container 100. The processor 412, upon receiving the temperature information from the temperature sensor 404, directs the indicator module 420 to indicate the temperature detected to the user. For example, when the liquid in the container 100 is determined to be cold (e.g. 0° C.-30° C.), the indicator module 420 may turn on the blue LED for 10 seconds; when the liquid the liquid in the container 100 is determined to be warm (e.g. 31° C.-60° C.), the indicator module 420 may turn on the green LED for 10 seconds; the liquid in the container 100 is determined to be cold (e.g. 60° C.-100° C.), the indicator module 420 may turn on the red LED for 10 seconds. In this 3 SMD LED example, if the processor 412 determines that the memory module 418 is full, it may cause the indicator module 420 to flash the red and green lights alternatively for 10 seconds, reminding the user that the memory module 418 is full (capacity used up). Furthermore, if the processor 412 determines that the power of the container 100 is low, it may cause the red light of the indicator module 420 to be turned on, so as to remind the user to supply power to the container 100. It should be appreciated the above example is non-limiting and the way of which the indicator modules 420 operates to provide information or reminder may vary in other embodiments, depending on the actual construction of the indicator module 420 (e.g., using display screen that display 2D or 3D graphics instead of SMD LEDs) and design choice.

The beverage container 100 in the present embodiment further includes a communication module 422 arranged to communicate data with an external electronic device 100. In one embodiment, the communication module 422 may be arranged in the space between the inner and outer containers 102*a*, 102*b*. Preferably, the communication module 422 is a wireless communication module that can communicate with the external electronic device in a wireless manner. For example, the communication module 422 may be a Wi-Fi module, a Bluetooth module, an NFC module, a RFID module, or a ZigBee module that can communicate with the external electronic device wirelessly. In one preferred embodiment, the communication module 422 is a Bluetooth module that can communicate data with the external electronic device using 4.0 BLE communication protocol. The communication between the electronic device and the communication module 422 of the container 100 may be initiated by either the electronic device or the container 100; and it can be established actively with the communication module 422 actively seeking a signal from the external device, or passively with the communication module 422 broadcasting a signal to be picked up by the electronic device. The communication module 422 in the present embodiment is operably connected with the processor 412 and/or the memory module 418 for transferring data gathered by the processor 412 or data stored in the memory module 418 to the external electronic device for storage or further processing or analysis. For example, the data that can be transferred to the external electronic device include the beverage consumption routine of the user. In one example, the communication module 422 is also operable to receive data or command from the external electronic device. For example, the communication module 422 may be operable to receive a predetermined beverage consumption alarm from the external electronic device.

In the present embodiment, the external electronic device operable to communicate with the communication module 422 of the container 100 may be any information handling system such as a smart phone, a smart bracelet, a laptop, a tablet computer, etc. Preferably, the external electronic device comprises suitable components necessary to receive, store and execute appropriate computer instructions. The components may include one or more of a processing unit, a read-only memory (ROM), a random access memory (RAM), disk drives, input devices such as a power port, a USB port, etc., I/O devices such as a touch sensitive display, a physical or virtual keyboard and communications links. The external electronic device preferably includes instructions that may be included in ROM, RAM or disk drives and may be executed by the processing unit. Optionally, a communication log between the container 100 and the electronic device may be recorded in the memory module 418.

The beverage container 100 in the present embodiment also includes a power module 424 operably coupled with the processor 412 and all other functional modules in the container 100. In one implementation, the power module 424 may be a rechargeable battery (e.g. Lithium based) arranged in the space between the inner and outer container bodies 102*a*, 102*b*. Preferably, the rechargeable battery can be recharged wirelessly or through a port (not shown in FIGS. 1A-3) arranged on the container body 100 to allow a charger power source (e.g. AC mains) to be connected with the battery, for example, via a power cable.

In a preferred embodiment, the power module 424 is operable to cooperate with the processor 412 to selectively operate the different functional modules in the beverage container 100. For example, the beverage container 100 in the present embodiment may be capable to operate in an idle mode when the beverage container 100 is not being used by the user (e.g. no pick up motion detected by motion detector 408, no lid state changes detected by lid state sensor 410, etc.) and in an active mode when the beverage container 100 is being used by the user (e.g. pick up motion detected by motion detector 408). In one embodiment, in the idle mode, only the motion sensor 408 and the lid state sensor 410 are in an operation (power on) state for detecting potential manipulation of the container 100 by the user, whereas the other functional modules are put in a reduced power (power off/hibernation) state. On the other hand, in the active mode, the motion sensor 408, the lid state sensor 410 and at least one other functional module as shown in FIG. 4 in the container 100 are in an operation (power on) state. In other embodiments, the power module 424 can selectively provide power to different functional modules for best resource utilization and energy efficiency. For example, the power module 424 may only provide power to the functional modules that need to be operated at that moment, or may dynamically adjust the level of power provided to different functional modules based on the needs or importance of the task to be performed by the different functional modules. By properly controlling the power supplied by the power module 424 to the other functional modules in the container 100, energy conservation can be achieved and resource utilization efficient can be improved, thereby prolonging the work time and efficiency of the container 100. It should again be stressed that the power module 424 in the present invention is capable of other implantations and power control regimes.

Whilst in the above embodiment the beverage container 100 is shown to include twelve different functional modules implemented using different mechanical and/or electrical elements, it should be appreciated that the beverage container 100 in other embodiments of the present invention need not include all of the twelve functional modules. For example, the beverage container 100 may not have a temperature sensor 404. On the other hand, the beverage container 100 in the present invention may include additional functional components. For example, the beverage container 100 may include a chemical sensor arranged to detect the chemical composition of the liquid contained in the beverage container 100. It should further be appreciated that other implementations and operation methods for operating and implementing the different functional modules illustrated are possible without departing from the spirit of the present invention.

Figure 5:
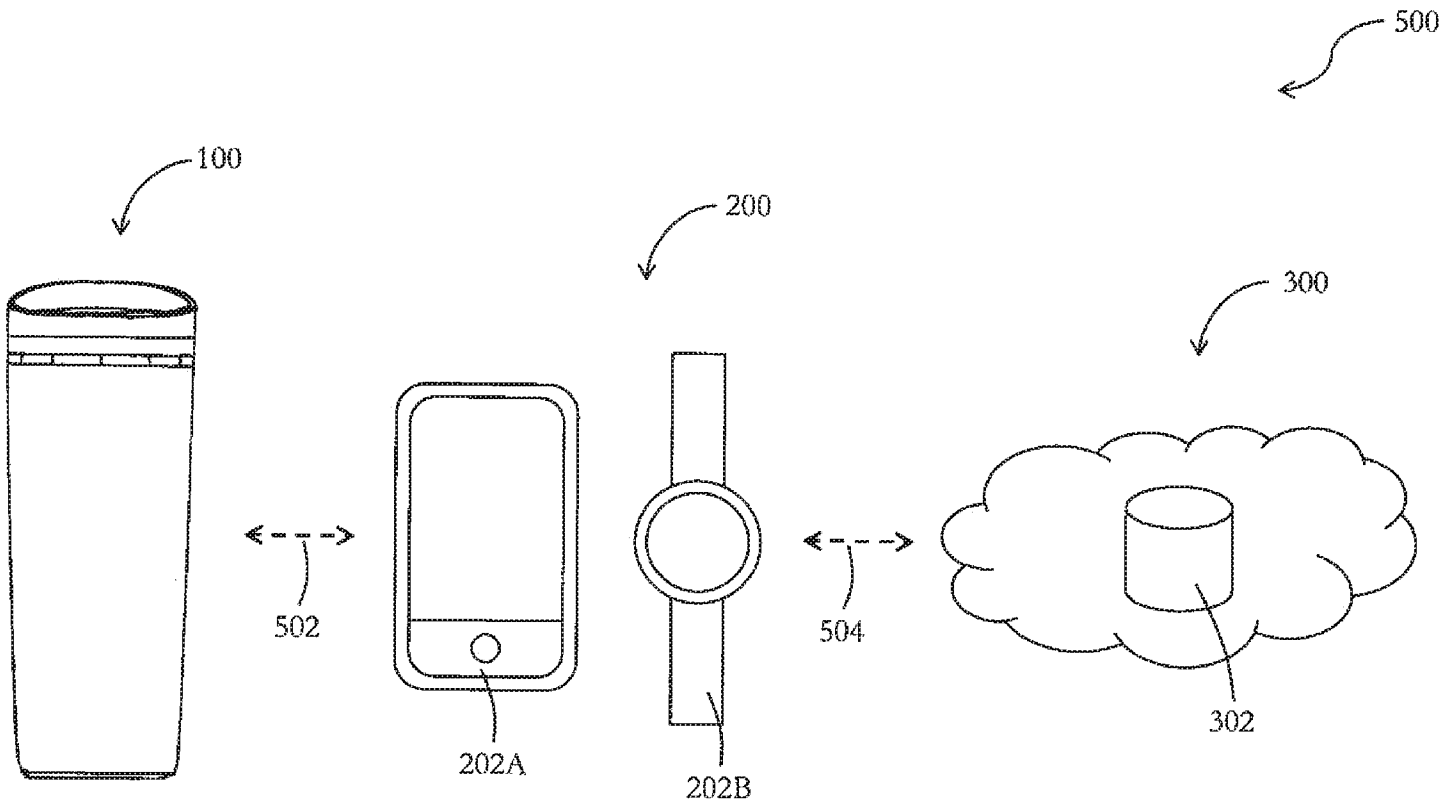
FIG. 5 illustrates the operation of a beverage consumption routine determination system in accordance with one embodiment of the present invention.

Referring to FIG. 5, there is provided a beverage container 100 operable to determine a beverage consumption routine of a user; an external electronic device 200 arranged to communicate with the beverage container 100; wherein the beverage consumption routine of the user is arranged to be transmitted from the beverage container 100 to the external electronic device 200 for storage in the external electronic device 200 or in a server 302 using the external electronic device 200.

FIG. 5 illustrates the operation of a beverage consumption routine determination system 500 in accordance with one embodiment of the present invention. In the present embodiment, the beverage consumption routine determination system 500 is shown implemented using the beverage container 100 of FIGS. 1A-4. However, it should be appreciated that other types of smart beverage containers can also be used.

As shown in FIG. 5, the beverage consumption routine determination system 500 includes a beverage container 100 and an external electronic device 200. In a preferred embodiment, the beverage container 100 is the one illustrated and described with respect to FIGS. 1A-4; and the external electronic device 200 is a smart phone 202A or a smart watch 202B. In some embodiments, other smart beverage containers, and other external electronic devices such as a smart bracelet, a laptop, a tablet computer, or other information handling systems may be used. Preferably, the external electronic device 200 comprises suitable components necessary to receive, store and execute appropriate computer instructions. The components may include one or more of a processing unit, a read-only memory (ROM), a random access memory (RAM), disk drives, input devices such as a power port, a USB port, etc., I/O devices such as a touch sensitive display, a physical or virtual keyboard and communications links. The external electronic device 200 preferably includes instructions that may be included in ROM, RAM or disk drives and may be executed by the processing unit.

In the present embodiment, the beverage container 100 (e.g., with communication module 422) and the external electronic device (with a communication module) are operably connected through a communication link 502 for communicating data. Preferably, the communication link 502 is a wireless communication link. Examples of this wireless communication link includes a Bluetooth communication link, a ZigBee communication link, etc. In an alternative embodiment, the communication link 502 may be a wired connection between the beverage container 100 and the external electronic device 200. In some embodiments, the communication link 502 may be encrypted. In one embodiment, the communication link 502 between the beverage container 100 and the external electronic device 200 may be established actively with the communication module 424 of the container 100 actively seeking a signal from the external device 200, or passively with the communication module 424 broadcasting a signal to be picked up by the electronic device 200. In one embodiment, the communication module 424 of the container 100 may be activated by the user through actuating a button (not shown) arranged on the container 100. In another embodiment, the communication module 424 of the container 100 may be activated automatically without user intervention.

As shown in FIG. 5, the external electronic device 200 is further connected to a server 302 through another communication link 504. In a preferred embodiment, the external electronic device 200 is connected to a server 302 that is arranged in a cloud computing arrangement 300 or a distributed computing arrangement distributed on individual software, hardware, or a combination of software and hardware components on a computer network, via a communication link which may be encrypted.

In the system 500 of FIG. 5, the beverage container 100 is operable to determine one or more of information relating to the liquid contained in the beverage container 100, the occurrence of the beverage consumption event, the beverage filling event, the beverage consumption routine of a user, the beverage consumption alarm, etc., and the time and duration associated with these information and results using the functional modules in the container 100 as described with respect to FIG. 4. In a preferred implementation, the beverage container 100 is operable to communicate these data to the electronic device 200 via communication link 502 when the user of the beverage container 100 connects the beverage container 100 with the electronic device 200. The data received by the electronic device 200 may be stored locally in a memory module of the electronic device 200 or may be further communicated to the server 302 in the cloud 300 via communication link 504. In other implementations, the beverage container 100 may be operable to communicate these data automatically to the electronic device 200 and hence to the server 302 in the cloud 300, or the beverage container 100 may be operable to communicate these data automatically to server 302 in the cloud 300 directly without using the electronic device 200. Preferably, the electronic device 200 is operable to retrieve these data from its local memory or from the server 302 in the cloud 300. The electronic device 200 can display the data to the user through a display screen, or perform further analysis using the data obtained.

In one embodiment, the beverage container 100 in the system 500 can be manipulated by the user through the electronic device 200 for controlling data communication in the system 500. For example, the user can associate the beverage container 100 with the electronic device 200 using an interface at the electronic device 200. The user may add or remove entries in the event log, measurement data, or edit the beverage consumption routine received from the beverage container 100 for updating the data in the electronic device 200. The user may also use the data received from the beverage container 100 for other fitness related analysis. For example, the user may use the beverage consumption data obtained from the beverage container 100 in combination with other fitness related measurements (e.g., food consumption, exercise, etc.) determined by other devices or modules for health related applications. The user may input into the electronic device 200 a beverage consumption alarm to be transferred to the beverage container 100 through the communication link 502. In one particular example where the electronic device 200 is a health or fitness related monitoring device (e.g. smart bracelet) that monitors the physiological signs (such as heart rate, breathing rate, etc.) of the user, the device 200 may determine that the user needs to consume fluid to remain hydrated based on the physiological signs measurements. Accordingly, the device 200 will determine and transmit a beverage consumption alarm to the beverage container 100 so as to remind the user of the need to consume fluid from the container 100.

It should be appreciated that the system 500 in the embodiment of the present invention is capable of modifications and variations, and is adapted for operation with different smart beverages containers and different electronic devices, under the system architecture as described with respect to FIG. 5. Accordingly, the interaction between the beverages container 100 and the electronic device 200 may also be different, depending on a specific application.

Figure 6:
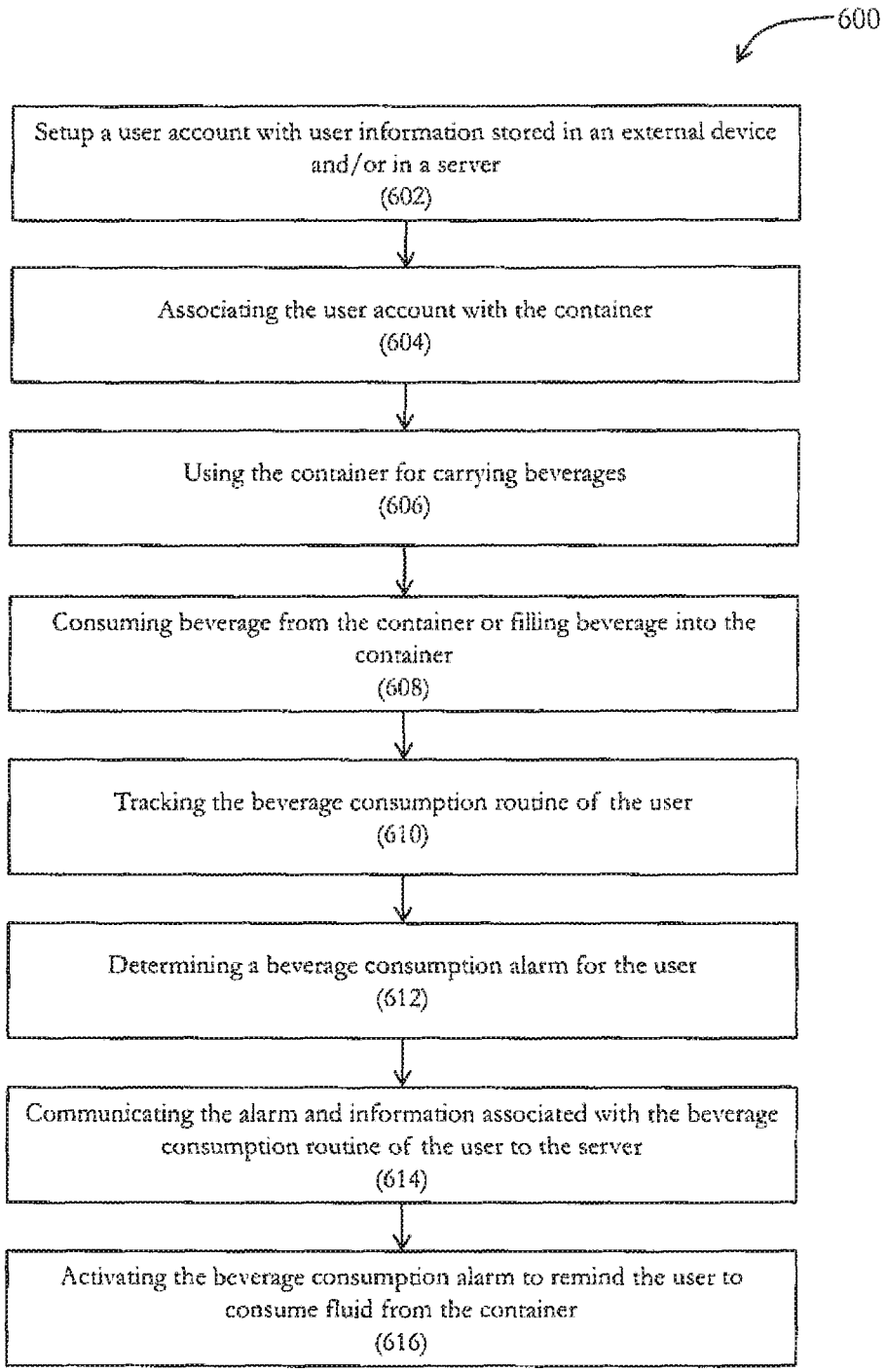
FIG. 6 is a flow diagram illustrating the overall operation of the beverage consumption routine determination system of FIG. 5 in accordance with one embodiment of the present invention.

The flow diagram 600 in FIG. 6 illustrates the overall operation of the beverage consumption routine determination system 500 of FIG. 5 in accordance with one embodiment of the present invention. In this embodiment, the method begins from step 602. In step 602, a user of the beverage container 100 sets up a user account through a software application or a webpage using the electronic device 200 (or other information handling systems). The user sets up his account by inputting his personal information such as weight, height, gender, age, etc., as well as the login information such as a username, password, etc., to the application or webpage. The above information may be stored locally in the electronic device 200 and/or in the server 302. In step 604, the user then associates the user account with the container 100. The container 100 can be associated with the user, for example, by establishing communication 502 between the electronic device 200 and the beverage container 100 and transmitting a user-specific token or identifier to the beverage container 100. After the container 100 has been associated with the user, the user can then use the beverage container 100 for carrying beverages, in step 606. The user may carry the beverage container 100 with him/her for carrying different kinds of beverages to be consumed. In step 608, the user may consume beverage from the container 100 and may subsequently refill beverage into the container 100. In some situations, the user may also discard or decant beverage from the container without consuming it. As illustrated in steps 610 and 612, the beverage container 100 is operable to track a beverage consumption routine of the user, and subsequently generate a beverage consumption alarm for the user to remind the user to consume fluid from the container 100. Details of the operation in steps 610 and 612 have been substantially described with reference to FIGS. 4 and 5, and thus will not be repeatedly describe below. However, in a preferred embodiment, the generation of the beverage consumption alarm also takes into account the weight, height, gender, age of the specific user, in addition to the information determined by the beverage container 100 or the electronic device 200. When the communication between the beverage container 100 and the server 302 is established (for example, via the electronic device 200 and communication links 502, 504; or directly with the server 302 without using the electronic device 200), the beverage container 100 may communicate the beverage consumption alarm, and information associated with the beverage consumption routine of the user to the electronic device 200 and hence to the server in step 614. In some cases, however, the information may not be immediately transferred to the electronic device 200 or the server 302. Rather the information may be stored locally in a memory module of the electronic device 200, with or without subsequent transfer to the server 302. Finally, in step 616, the beverage consumption alarm is broadcasted to the user to remind the user to consume fluid from the container 100. In one implementation, the beverage consumption alarm may be provided to the user through either the alarm module 414 of the beverage container 100 or through other alarm means in the external device 200, or both.

Figure 7:
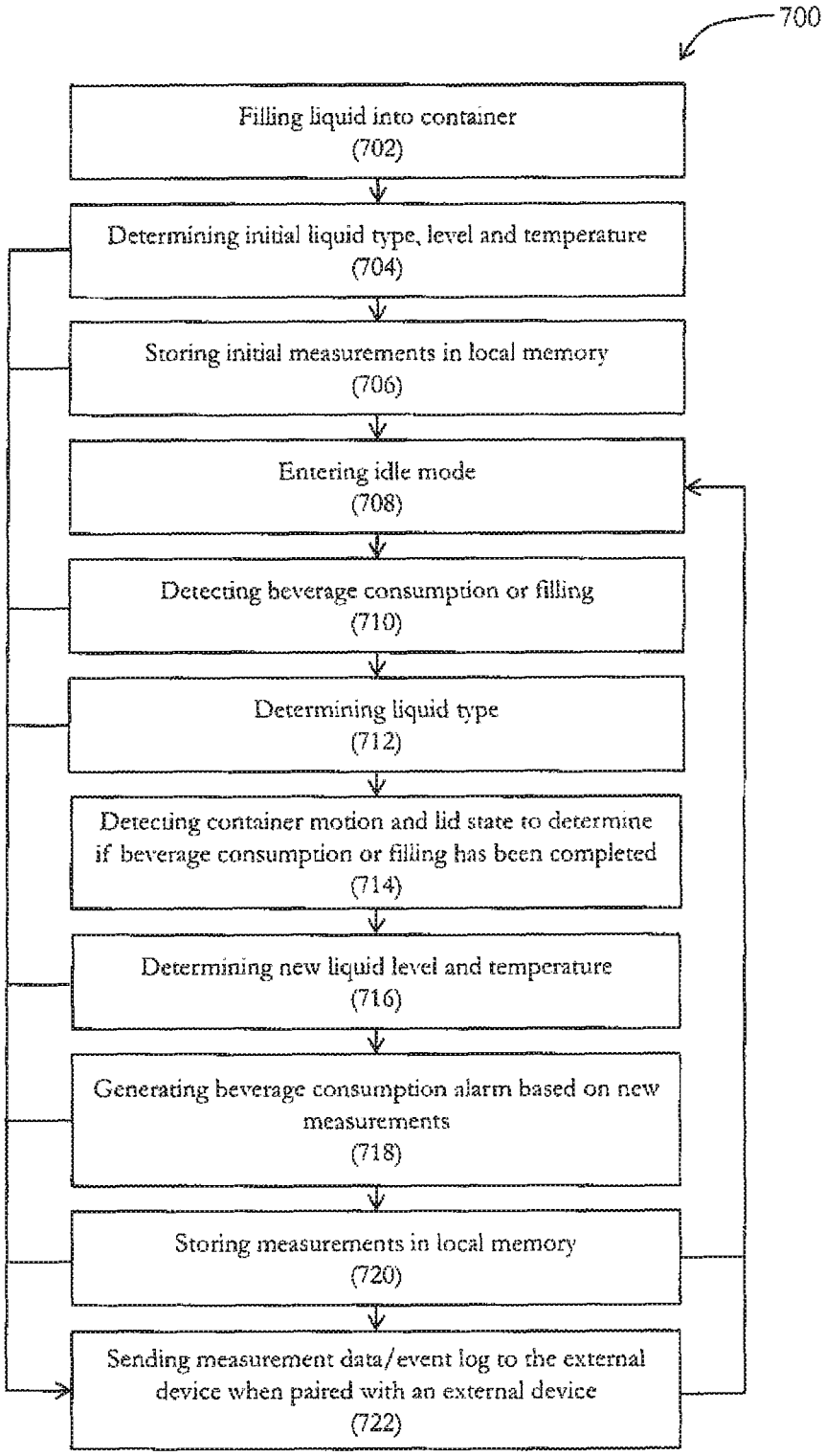
FIG. 7 is a flow diagram illustrating the operation of the beverage container in the beverage consumption routine determination system of FIG. 5 in accordance with one embodiment of the present invention.

FIG. 7 illustrates an exemplary operation 700 of the beverage container 100 in the beverage consumption routine determination system 500 of FIG. 5 in accordance with one embodiment of the present invention. Initially, the beverage container 100 is empty, and the user fills a liquid or beverage into the container 100 in step 702. In one example of step 702, the user may disconnect the lid 104 from the container body 102 and fill liquid into the body 102. After filling the container body with liquid, the user then connects the lid 104 back to the container body 102. In another example, the user may pivot the lid member 110 to an open position so as to enable access to the opening of the lid 104, and fills liquid into the container body 102 through the opening of the lid 104. After filling the container body with liquid, the user then pivots the lid member 110 back to a closed position. Once the container 100 determines that a beverage filling event has occurred based on the detection results of the lid state sensor 410 and the motion sensor 408, it then proceeds to determine the type, the amount and the temperature of the liquid filled into the container body 102 using the liquid detector 406, the level sensor 402 and the temperature sensor 404 of the container 100 as shown in step 704. Details of these measurement and detections have been described in detail with reference to FIG. 4, and thus will not be repeatedly described. In step 706, after the initial measurements have been completed, the beverage container 100 stores the measured liquid type, temperature and volume into its local memory module 418. In one embodiment, the timing module 416 in the beverage container 100 may associate the measurements with a measurement time or duration. After step 706 has been completed, the beverage container 100 then enters an idle mode in step 708. In the idle mode, all functional modules except the lid state sensor 410 and the motion sensor 408 in the container 100 are placed in a reduced power (power off/hibernation) state. In entering an idle mode when the container 100 is not manipulated by the user, energy and system resources of the container 100 can be better utilized.

If the container 100 then detects that it is being picked up by the user and the lid 104 of the container is being manipulated, it determines whether a beverage consumption event or a beverage filling event has occurred in step 710. In one embodiment, when the container 100 determines that it is being picked up by the user using the motion sensor 408, the processor 412 and the indicator module 420 may be activated to display to the user the temperature, type or volume of liquid contained in the container 100. If in step 710 the processor 412 of the container 100 determines based on the measurement of the motion sensor 408 that a beverage consumption event or a beverage filling event is occurring, it proceeds to step 712 to determine the type of liquid that is being filled into the container 100. In one embodiment, step 712 may be omitted if the container 100 determines that the event is a beverage consumption event. In step 714, the container 100 determines whether the beverage consumption event or the beverage filling event has been completed. Upon detecting that the beverage consumption event or the beverage filling event has completed, the beverage container 100 proceeds to step 716 to determine a new level and temperature of liquid in the container 100 using the level sensor 402 and the temperature sensor 404. Again, this step 716 is performed using the level sensor 402 and the temperature sensor 404 in the container 100. In another embodiment, the liquid type detection in step 710 may occur only after the container determines that the beverage consumption event or the beverage filling event has completed in step 716. Next, in step 718, the processor 412 of the container 100, upon receiving the updated type, volume and temperature information of the liquid contained in the container 100 based on the measurement results of the sensors 402, 404, 406, determines or updates a beverage consumption routine of the user and generates a beverage consumption alarm based on the new measurements. Preferably, the personal information (weight, height, age, etc.) of the user is also taken into account for determining a personalized beverage consumption alarm. One or more of the beverage consumption events or beverage filling events, the information determined by the plurality of sensors, the beverage consumption routine of the user, the beverage consumption alarm schedule, as well as the time and/or duration associated with these events and results are then stored locally in the memory module 418 in the container in step 720. In step 722, when the communication link 502 between the container 100 and the external device 200 is established, the container 100 sends all the above measurement data and event log in its memory module 418 to the external electronic device 200 for storage or further processing. In one embodiment, whenever the communication link 502 between the container and the external device is established, for example, after steps 704, 706, 710, 712, 716, 718 or 720, the container 100 may transfer data in its local memory module 418 to the external device 200.

Upon completion of step 720, if the container 100 fails to establish the communication link 502 with the external electronic device 200, then the container 100 will enter idle mode and the data will be stored in the memory module 418 of the container 100. The data stored will be transferred to the external electronic device 200 at a later stage, when the communication link 502 is available. On the other hand, if the container 100 successfully establishes the communication link 502 with the external electronic device 200 to transfer data to the device 200, then after step 722 when the data has been completely transferred to the external electronic device 200, the container 100 may delete the data that has been transferred to the external device 200 from its local memory 418, freeing up the space in the memory module 418. Subsequently, the container 100 may enter idle mode in step 708.

Figure 8:
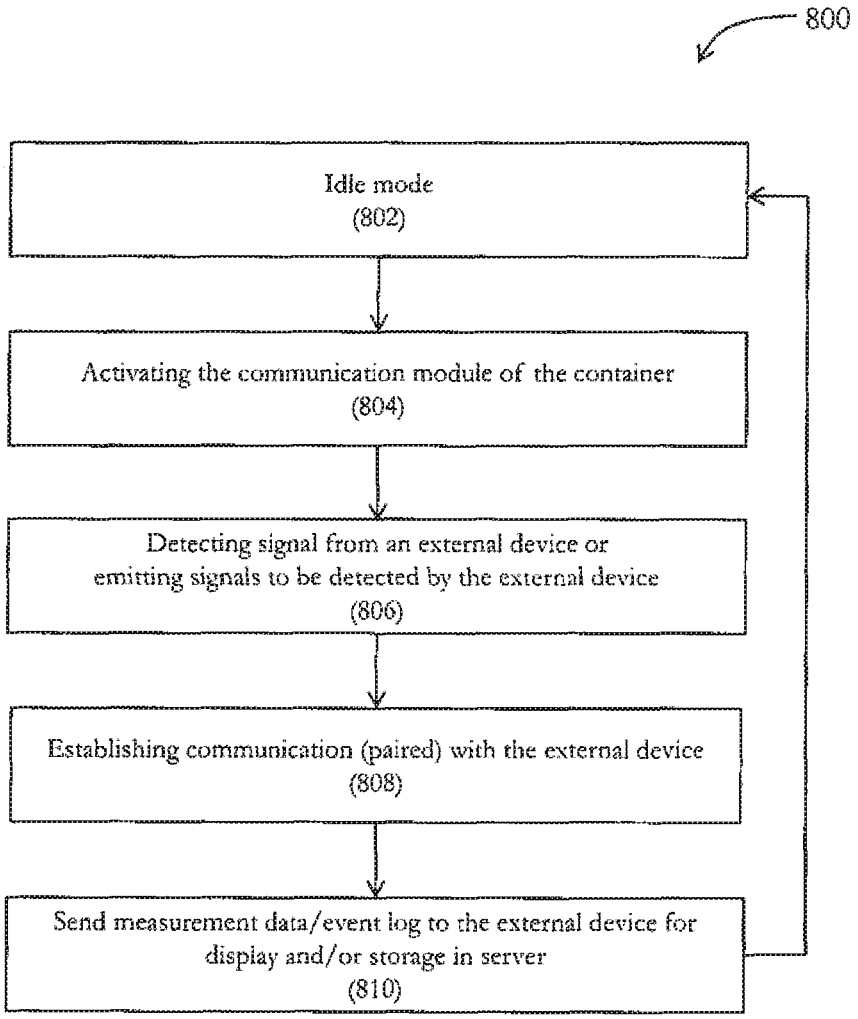
FIG. 8 is a flow diagram illustrating the operation of the beverage container in the beverage consumption routine determination system of FIG. 5 in accordance with one embodiment of the present invention.

FIG. 8 illustrates an exemplary operation 800 of the beverage container 100 in the beverage consumption routine determination system 500 of FIG. 5 in accordance with one embodiment of the present invention. In step 802, the container 100 is originally in an idle mode, where only the lid state sensor 410 and the motion sensor 408 are in the normal operating (power on) state. In step 804, the user may actuate the communication module 422 of the container by pressing an actuation button arranged on the container body 102. Alternatively, in step 804, the communication module 422 may be activated periodically or automatically for detecting the presence of the external electronic device 200. Upon activation, the communication module 422 of the container 100 will either actively look for signals from the external electronic device 200 or broadcast a signal to be detected by the electronic device 200 in step 806, as an attempt to establish the data communication link 502 with the external electronic device 200. If the external electronic device 200 happens to be within a connection range of the container 100, the data communication link 502 between the two devices 100, 200 will be established in step 808. In one embodiment, this step 808 further involves authentication and verification at the container 100 or at the external device 200 or both. For example, a user may be prompted to enter a username and passcode at the external electronic device 200 for establishing the communication link 502 between the container 100 and the external electronic device 200. Once the communication link 502 between the container 100 and the external electronic device 200 is established, measurement data and event log stored in the memory 418 of the container 100 can be transferred to the external device 200 for display, storage or further analysis, in step 810. In one embodiment, the data and event log are also preferably stored in the server 302 in the cloud 300. Upon completion of the data transfer process, the container 100 may enter the idle mode again in step 802.

Figure 9:
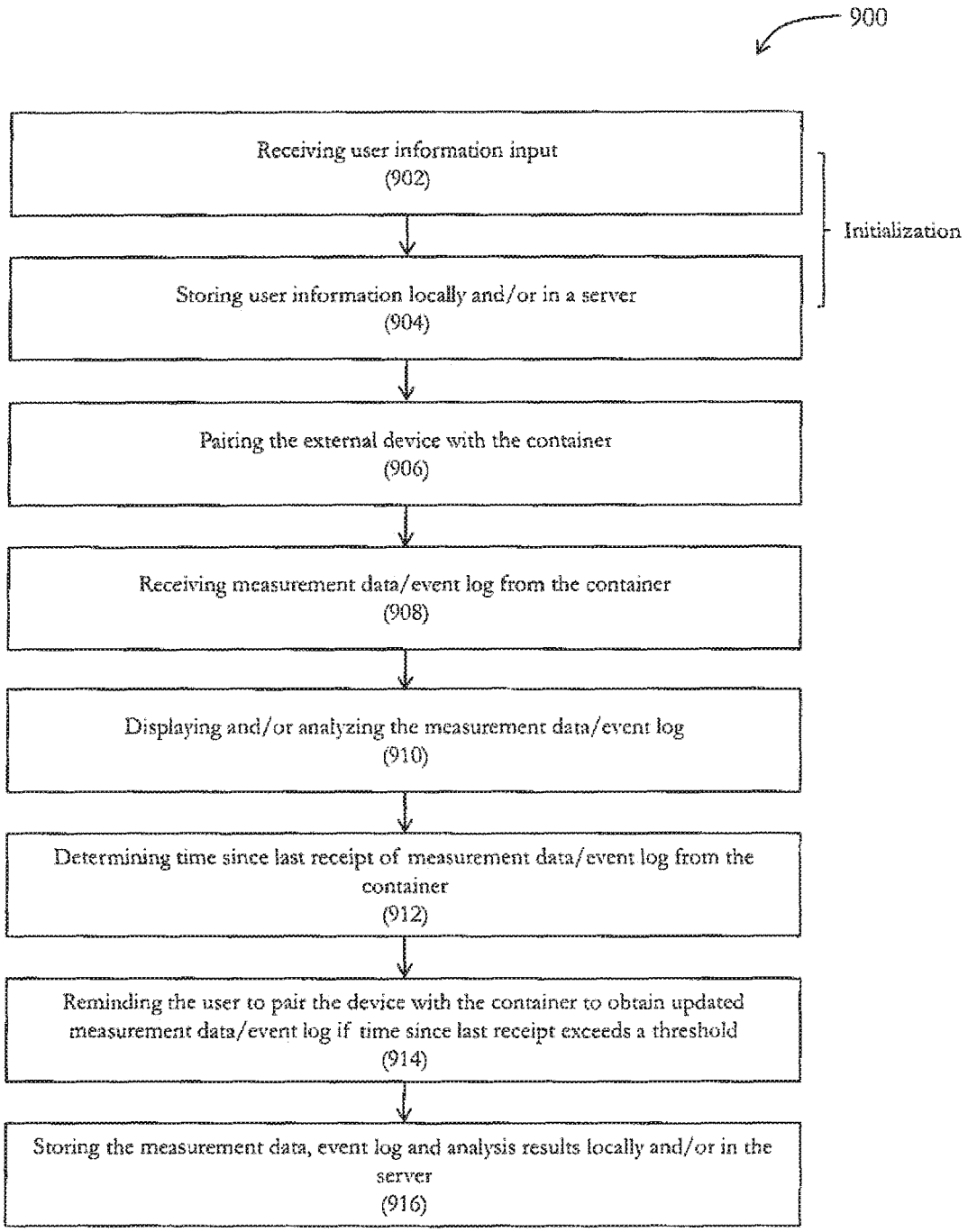
FIG. 9 is a flow diagram illustrating the operation of the external electronic device in the beverage consumption routine determination system of FIG. 5 in accordance with one embodiment of the present invention.

The flow diagram in FIG. 9 illustrates an exemplary operation 900 of the external electronic device 200 in the beverage consumption routine determination system 500 of FIG. 5 in accordance with one embodiment of the present invention. Steps 902 and 904 are initialization steps, and they need not be performed every time the external electronic device 200 operates in the system 500. In step 902, the user attempts to set up a user account associated with the container 100 using a software application installed on the electronic device 200 or a using webpage accessed through the electronic device 200. The user may enter his personal information and login information such as weight, height, gender, age, login username, password, etc. into the software application or webpage to setup an account. In step 904, the account information entered by the user may be sent to the server 302 in the cloud 300 for storage or may be stored locally in a memory module of the electronic device 200. In one embodiment, the information entered by the user is stored both locally in the electronic device 200 and in the cloud server 302. The information is preferably encrypted. In step 906, the user may establish the communication link 502 with the container 100 using the device 200. The communication link 502 may be established actively or passively as described above. Upon successfully establishing the communication link 502, the electronic device 200 may then receive measurement data and event log from the container, in step 908. Subsequently, in step 910, the electronic device 200 may display the measurement data and event log received from the container 100 on a display screen. The electronic device 200 may further analyse the data to be displayed to the user. In one embodiment, the measurement data and event log can be edited by the user on the electronic device 200. Furthermore, in some embodiments, the user may transmit data or alarm or other commands back to the container 100 using the electronic device 200 through the communication link 502. In step 912, the electronic device 200 determines the time since last establishing communication with the container 100, or a time since last receipt of measurement data and event log from the container 100. If the electronic device 200 determines that the time since last establishing communication with the container 100, or a time since last receipt of measurement data and event log from the container 100 exceeds a certain threshold, the electronic device 200 will prompt the user to connect the electronic device 200 with the container 100 for downloading data and event log from the container 100 in step 914. In one embodiment of providing such connection reminder, the electronic device 200 may provide an audible or a tactile or other forms of alert (e.g. through an email or a message, etc.) to the user locally. In step 916, the user subsequently connects the electronic device 200 with the beverage container 100 so as to retrieve the latest measurement data and event log from the beverage container 100. The measurement data and event log, or the analysis results generated during the analysis process in the electronic device 200 may be stored locally in a memory module of the device 200, and may be preferably sent to the server 302 in the cloud 300 for storage.

It should be readily appreciated that the operation steps illustrated in FIGS. 7-9 are merely exemplary in one embodiment of the present invention for better understanding the operation of the beverage consumption routine determination system 500 in the present invention. In other embodiments, the external electronic device 200 and beverage container 100 are operable to perform the same function in a different sequence, and are further operable to perform additional functions based on their specific implementations.

Figure 10:
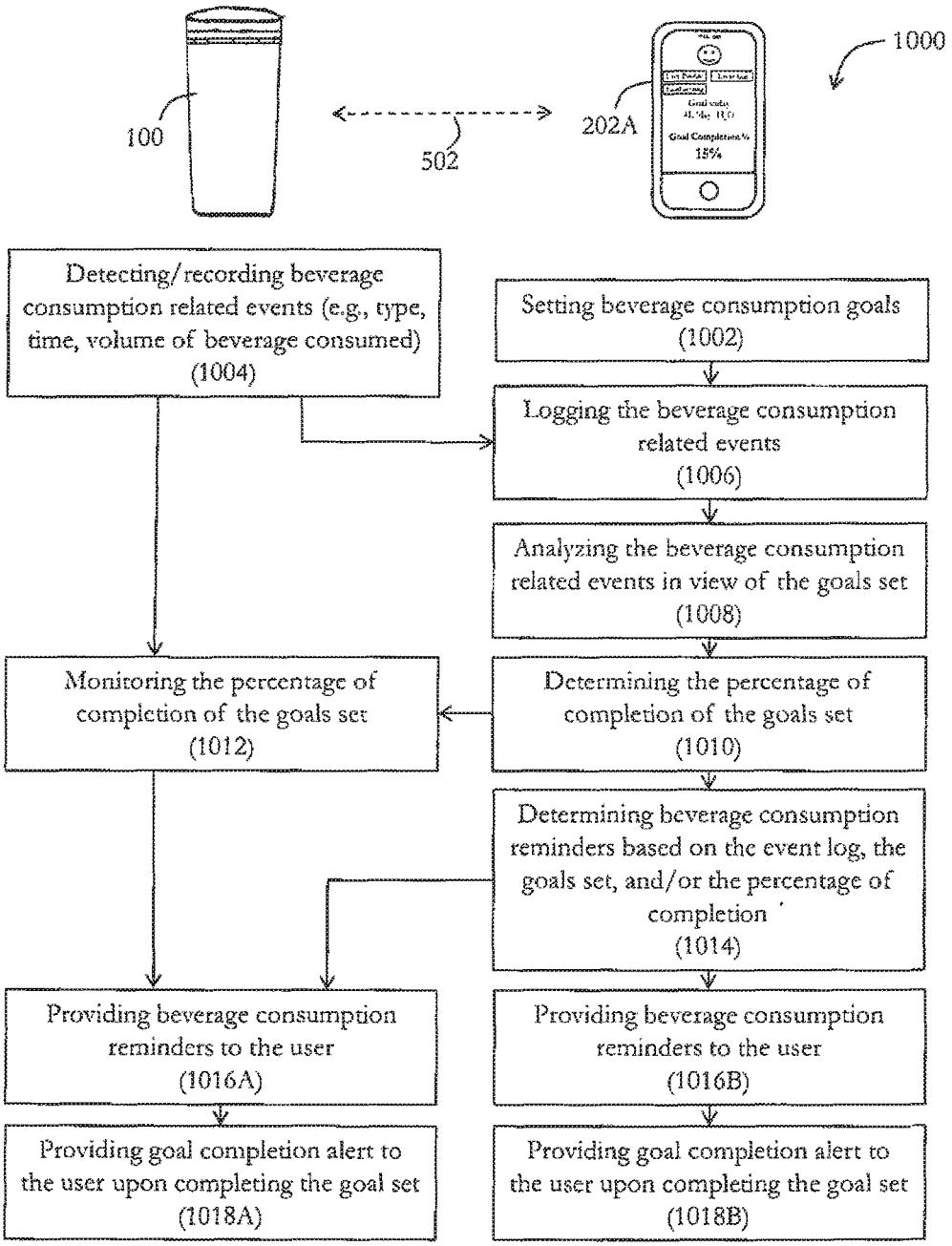
FIG. 10 is a flow diagram illustrating an exemplary software application integration operation of the beverage consumption routine determination system of FIG. 5 in accordance with one embodiment of the present invention.

FIG. 10 illustrates an exemplary software application integration operation 1000 of the beverage consumption routine determination system 500 of FIG. 5 in accordance with one embodiment of the present invention. In the example of FIG. 10, the beverage container 100 is in wireless data communication with the smart phone 202A through the communication link 502. In the present example, the smart phone 202A is installed with a software application ("app") that allows the user to interact with the beverage container 100 (refer to the exemplary interface on the screen of the phone 202A in FIG. 10). Specifically, the software application allows the user to set specific beverage consumption goals such as the amount of beverage (e.g., water) to be consumed in a certain period of time (e.g., per day). After setting the goal, the beverage container 100 and/or the smart phone 202A will monitor and analyse the beverage consumption routine of the user, and provide suitable indicators or reminders to the user at appropriate times so as to help to user to achieve the goal set. The details of the exemplary operation 1000 will now be described.

Referring to FIG. 10, in step 1002, the user sets beverage consumption goals through the software application installed on the smart phone 202A. Preferably, the user may set up a user account with his/her personal information (gender, weight, height, etc.), and pair his or her beverage container 100 with the smart phone 202A through the software application. In one embodiment, the software application is operable determine the amount of beverage (e.g., water) that needs to be consumed by the user for a certain period of time (e.g. daily) based on the user's personal information (gender, weight, height, etc.). In another embodiment, the user may input his or her own beverage consumption goal into the software application, i.e., the amount of beverage (e.g., water) that needs to be consumed by the user for a certain period of time (e.g. daily) is determined by the user him-/her-self but not calculated by the phone 202A. Preferably, the beverage consumption goal, once set in step 1002, is stored locally in the smart phone 202A, and optionally, in a server accessible by the smart phone 202A. After the initial set up in step 1002, in step 1004, the beverage container 100 detects, monitors, and records the beverage consumption events and/or beverage filling events of the user (e.g., as previously described with reference to FIGS. 4-8). As the user carries out his or her daily activities, he or she may consume beverage from the container 100, or alternatively, fill the container 100 with new beverage. Accordingly, the beverage container 100 may detect the type of beverage consumed, the volume of beverage consumed, and the time associated with these events.

In step 1006, the beverage consumption events and/or beverage filling events of the user that are monitored and recorded by the container 100 are transmitted from the container 100 to the phone 202A through communication link 502. This transmission can be done periodically, instantaneously or manually (e.g. by press a sync button on the phone 202A), depending on the availability of the communication link 502 between the container 100 and the phone 202A. In step 1006, the phone 202A maintains a log of the beverage consumption data including the amount of beverage consumed, the type of beverage consumed, and the time associated with these events locally, and optionally, in a server accessible by the smart phone 202A. Then, in step 1008, the phone 202A analyses the beverage consumption data based on the beverage consumption goal initially set in step 1004. The analysis may include calculating the total consumption from the starting time, the time since last consumption, the sequence of the type of beverage consumed, etc.

In step 1010, the smart phone 202A determines the percentage of completion of the goal. The phone 202A may display the percentage value on its screen through the interface of the software application. In an illustrative example, if the user has initially set a goal of consuming four liters of water in one day, and the beverage consumption data shows that the user has, since the starting time, consumed 0.6 liters of water, the phone 202A will determine that the goal completion percentage is 0.6/4=15%. Preferably, in this example, the phone 202A is operable to scan through the beverage consumption log of the user to eliminate beverage consumption entries that are not related to water. For example, the phone 202A may discard the reading of the amount of coffee consumed in its calculation of the total amount of water consumed. In a more advanced embodiment, however, the software application on the phone 202A may be pre-programmed to apply a weighing factor to the coffee consumption entry in the log in determination of the amount of water consumed (as coffee also comprises water), thereby taking into account the coffee consumption entry in calculating the amount of water consumed.

Upon determining the percentage of completion of the goal in step 1010, the phone 202A may transmit the result to the container 100 through the communication link 502 for storage in the local processor or memory of the container 100. In step 1012, the beverage container 100 can continue to monitor or determine the percentage of completion of the goal initially set based on the continuous monitoring and recording of the beverage consumption related events and data obtained in step 1004.

On the other hand, after step 1010, the phone 202A may proceed to determine beverage consumption reminders or alerts based on the analysis of the beverage consumption data obtained from the container 100, as shown in step 1014. In particular, the phone 202A may determine beverage consumption reminders based on the event log, the beverage consumption goals set, and/or the percentage of completion of the goal. In one embodiment, the phone 202A may determine the time for alerting the user to consume beverage based on the type and amount of beverage last consumed and/or the time since last consumption of a particular type of beverage to prevent the user from being dehydrated. In addition, the phone 202A may determine the time for reminding the user of the percentage of completion of the goal set initially. The times for providing these alerts to the user is then stored locally in the phone 202A, as well as transmitted to the container 100 for local storage through communication link 502. These times are also optionally stored in a server accessible by the phone 202A.

In steps 1016A and 1016B, the container 100 and/or the phone 202A may provide the alerts to the user at the determined times to remind the user of dehydration, or to remind the user of the outstanding goal set initially. For example, the phone 202A may provide an audible alarm and/or a vibratory alarm that reminds the user the need to consume beverage to stay hydrated. The phone 202A may also display other graphical notifications (e.g., the word "DRINK NOW", the percentage of goal completed, etc.) on the screen through the interface of the software application, to provide a beverage consumption alert or an outstanding goal alert to the user at the determined time. On the other hand, the container 100 may also provide the same alerts to the user using, for example, the alarm module 414. In one particular example, the alarm module 414 may comprise three surface-mount-device light-emitting diodes (SMD LED) of different colour (e.g., red, blue, green) and a vibration motor. In this example, the container 100 may turn on the red LED and/or vibrate the motor to indicate a beverage consumption alarm; or may flash all LEDs intermittently when the goal has not yet completed. In the present example, the beverage consumption alert or the outstanding goal alert may be provided by both the container 100 and the phone 202A at the same time, or provided by any one of the container 100 and the phone 202A.

In steps 1018A and 1018B, the container 100 and/or the phone 202A may provide the alerts to the user upon determining that the goal is completed. For example, the phone 202A may provide an audible alarm and/or a vibratory alarm, or display other graphical notifications on the screen through the interface of the software application to notify the user that the goal has been completed. The container 100 may also provide the same alerts to the user using, for example, the alarm module 414. In one particular example, the alarm module 414 may comprise three surface-mount-device light-emitting diodes (SMD LED) of different colour (e.g., red, blue, green) and a vibration motor. In this example, the container 100 may turn on the blue LED and/or vibrate the motor to indicate that the goal has been completed. The goal completion indicator may be provided by both the container 100 and the phone 202A at the same time, or provided by any one of the container 100 and the phone 202A.

It should be readily appreciated that the software application integration operation steps illustrated in FIG. 10 are merely exemplary for the sake of illustrating the software application integration operation of the beverage consumption routine determination system 500. The beverage container 100 and the smart phone 202A (or other external electronic device in communication with the beverage container 100) are operable to perform similar functions in a different operation sequence, and are further operable to perform additional functions based on specific implementations. Also, in some embodiments, the external electronic device need not be a smart phone 202A, but can be a tablet, a portable computer, or other type of electronic devices that are operable to communicate wirelessly with the beverage container 100.

Embodiments of the smart beverage container in the present invention are advantageous in that it can readily determine information associated with liquid contained in the container body, as well as manipulation of the container by the user, so as to determine a beverage consumption routine of the user. The beverage container in the present invention can monitor the daily fluid consumption routine of a user in an automatic and efficient manner. This is partly because the operation of the module in the container is largely automated, and the container is capable of energy conservation using an idle mode when appropriate. Furthermore, the beverage container is operable to provide alarm automatically to remind the user when and how much fluid needs to be consumed in order for the user to remain properly hydrated. More importantly, this alarm is tailored to the need of the user as the generation of the alarm takes into account not only the beverage consumption record of the user, but also the weight, height, gender, age, and other person information of the user. A log of all beverage consumption activities of the user can be maintained automatically. By providing these functions, the beverage container in the present invention can integrate seamlessly into the user's daily life to improve the health and fitness of the user. Specific structural and functional arrangements of the sensors, indicators, processors, and other modules in the beverage container are also advantageous, and a person skilled in the art would readily appreciate these advantages in terms of function, operation efficiency, cost, ease of operation, ease of manufacture, accuracy of measurement, etc., upon reading the description.

Embodiments of the beverage consumption routine determination system in the present invention are also advantageous. By monitoring a beverage consumption pattern of a user using the beverage container, and gather the information for storage and analysis, a tailored fitness program may be created for the user. Also, by providing a software application integration feature that enables a beverage consumption goal implementation, the beverage container system can be readily adapted for fitness and health related applications, thereby promoting hydration awareness and improving health of the user. The beverage consumption pattern of the user monitored by the container may be used in conjunction with other monitoring results provided by other monitoring devices. For example, the beverage consumption pattern of the user may be used together with a fitness tracker, such that when the user is performing exercise, the electronic device can take into account the physiological measurements of the user (via other fitness monitoring or detection devices) for generation of beverage consumption alarm. In another setting, the beverage consumption routine determination system may be used by a patient who is required to take certain amount of fluidic medication. In this example, the patient may use the beverage container solely for consuming the medication, and the consumption data may be transmitted to an electronic device and hence to a database in a hospital or clinic. Alternatively, in the embodiment in which the beverage container is operable to communicate data automatically to server in the cloud directly without using the electronic device, the consumption data may be directly stored in the cloud server. In that way, a medical practitioner may readily monitor the medication consumption pattern of the user remotely. Also, the patient may be reminded of the need to take the medication, as well as the time and volume of which the medication needs to be taken, by the beverage container in the present invention. Based on the above example, it can be appreciated that applications and thus advantages of the beverage consumption routine determination system are numerous, and these would be apparent to a person skilled in the art upon reading and understanding the detailed description above.

Although not required, the embodiments described with reference to the Figures can be implemented as an application programming interface (API) or as a series of libraries for use by a developer or can be included within another software application, such as a terminal or personal computer operating system or a portable computing device operating system. Generally, as program modules include routines, programs, objects, components and data files assisting in the performance of particular functions, the skilled person will understand that the functionality of the software application may be distributed across a number of routines, objects or components to achieve the same functionality desired herein.

It will also be appreciated that where the methods and systems of the present invention are either wholly implemented by computing system or partly implemented by computing systems then any appropriate computing system architecture may be utilised. This will include stand-alone computers, network computers and dedicated hardware devices. Where the terms "computing system" and "computing device" are used, these terms are intended to cover any appropriate arrangement of computer hardware capable of implementing the function described.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A liquid container comprising:

a container body having a first portion and a second portion continuous with the first portion, the first and second portions together defining a volume for receiving liquid;

a plurality of emitters and receivers forming emitter-receiver pairs arranged externally to the second portion of the container body and spaced apart along a lengthwise direction of the second portion of the container body; the emitter of each of the plurality of emitter-receiver pairs is arranged to transmit a signal towards the corresponding receiver of the plurality of emitter-receiver pairs through the second portion of the container body;

wherein the plurality of emitter-receiver pairs include:

one or more first emitter-receiver pairs forming level sensors for detecting an amount of liquid in the container body; and a second emitter-receiver pair forming a liquid detector for detecting a type of liquid contained in the container body, wherein the second portion comprises a first wall, a second wall, and a third wall arranged between the first and second walls; the first, second and third walls being formed continuously; the first and second walls is arranged adjacent the plurality of emitter-receiver pairs and between the emitter and the receiver of each of the plurality of emitter-receiver pairs;

wherein portions of the first and second walls arranged between each of the one or more first emitter-receiver pairs are substantially planar and are arranged at an angle of less than 90 degrees with each other, and wherein portions of the first and second walls arranged between the second emitter-receiver pair are substantially planar and are arranged parallel with each other.

2. The liquid container in accordance with claim 1, wherein portions of the first and second walls arranged between each of the one or more first emitter-receiver pairs are arranged at an angle between 45-75 degrees.

3. The liquid container in accordance with claim 1, wherein portions of the first and second walls arranged between each of the one or more first emitter-receiver pairs are arranged at an angle of 60 degrees.

4. The liquid container in accordance with claim 1, further comprising:

a circuit board connected to the container body adjacent the second portion of the container body, the circuit board having the plurality of emitter-receiver pairs disposed or mounted lengthwise along the circuit board; and a circuit module electrically connected with the plurality of emitter-receiver pairs.

5. The liquid container in accordance with claim 1, wherein the second emitter-receiver pair is arranged at a lower half of the container body when the container is in an upright configuration.

6. The liquid container in accordance with claim 1, wherein the second emitter-receiver pair is arranged below at least one of the one or more first emitter-receiver pairs when the container is in an upright configuration.

7. The liquid container in accordance with claim 1, wherein the plurality of emitters and receivers are infrared emitters and infrared receivers adapted to emit and receive infrared signals; and wherein the first and second walls are infrared-transmissive, and the first and second walls are operable to alter a wave speed of the infrared signal.

8. The liquid container in accordance with claim 1, wherein the one or more first emitter-receiver pairs are arranged to detect the amount of liquid in the container body based on the presence or absence of signal received at the corresponding receivers.

9. The liquid container in accordance with claim 1, wherein the second emitter-receiver pair is arranged to detect the type of liquid contained in the container body based on a difference of signal strength between a signal emitted by the emitter and a signal received at the corresponding receiver.

10. The liquid container in accordance with claim 1, wherein the liquid container is a portable beverage container.

11. The liquid container in accordance with claim 10, further comprising a processor operably coupled with the plurality of emitters and receivers for determining a beverage consumption routine of a user based on the information determined by the plurality of emitters and receivers; the beverage consumption routine includes one or more of: type of the liquid consumed by the user and volume of the liquid consumed by the user, and time at which the liquid is consumed by the user.

12. The liquid container in accordance with claim 11, wherein the processor is arranged to determine a beverage consumption alarm to be provided to the user based on the beverage consumption routine of the user; wherein the beverage consumption alarm is arranged to remind the user of consumption of liquid from the beverage container.

13. The liquid container in accordance with claim 12, further comprising an alarm module operably coupled with the processor for providing the beverage consumption alarm to the user.

14. The liquid container in accordance with claim 11, further comprising a temperature sensor arranged to detect a temperature of the liquid in the container body.

15. The liquid container in accordance with claim 11, further comprising a motion sensor arranged to detect a motion of the beverage container being picked up.

16. The liquid container in accordance with claim 15, further comprising: a lid removably coupled with the container body; and a lid state sensor arranged to detect if the lid is opened or closed, or connected with or disconnected from the container body.

17. The liquid container in accordance with claim 11, further comprising: a rechargeable battery operably coupled with the processor and the plurality of emitters and receivers for selectively powering the processor and one or more of the plurality of emitters and receivers.

18. The liquid container in accordance with claim 11, further comprising: a wireless communication module arranged to communicate the beverage consumption routine of the user to an external electronic device.

19. The liquid container in accordance with claim 11, further comprising: a clock or timing module operably coupled with the processor for recording time of events occurred.

20. The liquid container in accordance with claim 11, further comprising: an indicator module operably coupled with the processor for indicating one or more of temperature, volume, and type of liquid contained in the container body.

21. The liquid container in accordance with claim 11, further comprising: a memory module operably coupled with the processor for storing one or more beverage consumption events or beverage filling events, the information determined by the plurality of emitters and receivers, the beverage consumption routine of the user and a beverage consumption alarm schedule.

22. The liquid container in accordance with claim 1, wherein the container body has a beverage chamber with a cross section defined by a continuous slot portion and major segment portion, the slot portion defining a channel extending at least partly lengthwise along the beverage chamber; wherein the level sensors are arranged along the channel defined by the slot portion.

* * * * *